US006769692B1

(12) United States Patent
Cavalluzzo

(10) Patent No.: US 6,769,692 B1
(45) Date of Patent: Aug. 3, 2004

(54) GAME METHOD FOR SHARPENING ANAGRAMMING SKILLS AND APPARATUS THEREFOR

(76) Inventor: I. Frank Cavalluzzo, 215 Bush St., Bronx, NY (US) 10457

( * ) Notice: Subject to any disclaimer, the term of this patent is extended or adjusted under 35 U.S.C. 154(b) by 186 days.

(21) Appl. No.: 10/055,570

(22) Filed: Jan. 22, 2002

(51) Int. Cl.[7] ..... A63F 3/00
(52) U.S. Cl. ..... 273/272; 273/293; 273/299
(58) Field of Search ..... 273/299, 293, 273/272

(56) References Cited

U.S. PATENT DOCUMENTS 3,396,972 A 8/1968 Smith
3,655,195 A 4/1972 Bean et al.
4,365,813 A 12/1982 Hirsh
4,384,722 A * 5/1983 Higgins ..... 273/272
4,896,889 A * 1/1990 Kuhn et al. ..... 273/272
5,230,518 A 7/1993 Crowe et al.
5,374,065 A 12/1994 Motskin
5,769,421 A 6/1998 Wakefield
6,168,439 B1 1/2001 Anderson
6,446,967 B1 * 9/2002 Jamali ..... 273/236

* cited by examiner

*Primary Examiner*—Vishu K Mendiratta
(74) *Attorney, Agent, or Firm*—Richard L. Miller

(57) ABSTRACT

An apparatus of a game method for sharpening anagramming skills. The apparatus includes at least one game card, a plurality of tiles, and a tile bag. The plurality of tiles are selectively positioned on the at least one game card to form words and the tile bag holds the plurality of tiles. The at least one game card has nine rows of a plurality of playing squares thereon, a draw column, a play column, and a bonus column. The plurality of tiles are positionable on the nine rows of a plurality of playing squares to form words. The draw column indicates the amount of the tiles to draw from the tile bag when playing each of the nine rows of a plurality of playing squares, the play column indicates the amount of tiles needed to be used to qualify for a bonus, and the bonus column indicates the amount of the bonus.

25 Claims, 24 Drawing Sheets

GAME METHOD FOR SHARPENING ANAGRAMMING SKILLS AND APPARATUS THEREFOR

BACKGROUND OF THE INVENTION

1. Field of the Invention

The present invention relates to a game method. More particularly, the present invention relates to a game method for sharpening anagramming skills and apparatus therefor.

2. Description of the Prior Art

Numerous innovations for word games have been provided in the prior art that will be described. Even though these innovations may be suitable for the specific individual purposes to which they address, however, they differ from the present invention.

A FIRST EXAMPLE, U.S. Pat. No. 3,655,195 to Bean et al. teaches a word-forming game apparatus comprising lettered playing pieces, each having thereon one or more color bars representative of the value of the letter, such value being inversely proportional to the frequency of occurrence of the letter. The players arrange the pieces to form words, with the pieces used being selected so as to score the highest possible number of points, and are awarded chips corresponding in number and color to the color bars on the pieces played. The winner is the player having the highest court in color chips.

A SECOND EXAMPLE, U.S. Pat. No. 4,365,813 to Hirsch teaches a word game including a plurality of playing pieces each having either a letter of the alphabet and a value indicator thereon or being universally useful as any letter of the alphabet, a ratio of lettered to universally useful pieces being at least about 10 to 1. A playing surface having a plurality of contiguous playing piece accepting playing spaces thereon in linear array. A device for generating a number by chance from a selected set of numbers to multiply the sum of the value indicators of the playing pieces on the playing surface to obtain a product after a player takes his turn. A plurality of value markers or the like to be paid to the player in an amount determined by the product developed on his turn. Also, a method of playing the word game utilizing the aforementioned structures.

A THIRD EXAMPLE, U.S. Pat. No. 5,230,518 to Crowe et al. teaches a mediated name game apparatus having a playing board involving randomly drawn playing tiles to be matched with names of noteworthy people having a first set of uniformly colored playing tiles inscribed with letters of and English alphabet and numbers, a second of playing tiles having a second uniform color, also inscribed with letters and numbers, a plurality of bag containers for concealed containment of the first and second sets of playing the tiles, the playing board consisting of a tray board divided into a plurality of columns for accepting and retaining the playing tiles corresponding to the first letters of selected by players of names of noteworthy people, and including a game card for listing the names and for scoring the associated numbers contained on the playing tiles selected and for a procedure for challenging and mediating names selected wherein the mediation is performed by referring to a mutually agreed upon reference source typically a book. The invention also relates to a method of play for matching playing tiles, having letters inscribed thereon, with names of noteworthy people from a selected category of activity, involving a procedure for challenging a one players section by an other player and for mediating the challenge by referring to an agreed-upon reference book or source.

A FOURTH EXAMPLE, U.S. Pat. No. 5,374,065 to Motskin teaches a language building game for two to four players utilizing a grid marked game playing board, a pool of playing tiles each bearing a letter of the alphabet on its face, and a scoring sheet for each player. The game method includes placing a first plurality of tiles on the board by a first placing only a single tile on the board adjacent to the first plurality of tiles by the second player, wherein the first and second players continue to build about the first plurality of tiles and the single tile by placing additional pluralities of tile on the board.

A FIFTH EXAMPLE, U.S. Pat. No. 5,789,421 to Wakefield teaches a word forming game which has a letter selection based on words used commonly in conversation. The word game of the present invention may include: one six-sided die; a game board having four player areas, each area numbered one through six to correspond to the numbers on the die; thirty-one letter tiles imprinted with commonly used letters on both sides of the tile; and a score card. According to a method of playing the game of a preferred embodiment, four players place letter tiles next to each number located in the player areas. By rolls of the die, each player selects four of the letters and attempts to form a word. Each player is given preferably eight rounds in which to form words. At the end of the game, the player may receive a bonus score for forming a sentence from the words formed during the game. Generally, each letter used to form a word counts one point. The scorecard is used to record the letters, words and the points. The player at the end of eight rounds with the highest total points is the winner.

A SIXTH EXAMPLE, U.S. Pat. No. 6,186,439 to Anderson teaches a word game for entertaining players and improving their vocabularies. The method of playing the word game comprises the steps of providing a plurality of tiles each with a front and a back. The front and back of each of the tiles has a unique letter of the alphabet imprinted thereon. A timer is provided. The timer expires after a predetermined amount of time has elapsed. A card is provided for each player, each having a plurality of columns and a series of rows. All players simultaneously participate. One player shakes all the tiles in a tumbler and lets one tile fall out. The front and the back of the tile are viewed and the timer is started. Players write two series of words on the card they are holding. Each of the series is written in a unique row of the card. Words is the first series begin with one of the letters of the tile. Words in the second series begin with the other of the letters of the tile. Each of the words written in the first of the columns is of one syllable. Words in consecutive columns increase by one syllable. A score of three points per word per syllable is assigned. The score of all words is summed to obtain a final score. The player having the highest final score is the winner.

It is apparent that numerous innovations for word games have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a game method for sharpening anagramming skills and apparatus therefor that avoids the disadvantages of the prior art.

ANOTHER OBJECT of the present invention is to provide a game method for sharpening anagramming skills and apparatus therefor that is simple and inexpensive to manufacture.

STILL ANOTHER OBJECT of the present invention is to provide a game method for sharpening anagramming skills and apparatus therefor that is simple to use.

BRIEFLY STATED, STILL YET ANOTHER OBJECT of the present invention is to provide an apparatus of a game method for sharpening anagramming skills. The apparatus includes at least one game card, a plurality of tiles, and a tile bag. The plurality of tiles are selectively positioned on the at least one game card to form words and the tile bag holds the plurality of tiles. The at least one game card has nine rows of a plurality of playing squares thereon, a draw column, a play column, and a bonus column. The plurality of tiles are positionable on the nine rows of a plurality of playing squares to form words. The draw column indicates the amount of the tiles to draw from the tile bag when playing each of the nine rows of a plurality of playing squares, the play column indicates the amount of tiles needed to be used to qualify for a bonus, and the bonus column indicates the amount of the bonus.

The present invention is an anagramming word game for 2–4 players. It can also be played alone to sharpen an individual's anagramming skills.

The present invention comprises 4 game cards, 103 tiles including 96 lettered tiles, 4 blank tiles, and 3 bonus tiles, a tile bag, and 4 optional racks.

The players form words on the game cards with the lettered tiles drawn from the tile bag, and compete for high scores by forming words with the highest point value. This is accomplished by utilizing point values of the letters played by taking advantage of the premium circles and by forming longer words so as to collect bonuses as diagrammed on the playing cards.

Initially, each player receives a game card, and all of the tiles are placed in the tile bag and mixed. The players then, in no particular order, draw from the tile bag the number of tiles indicated under the DRAW column on the game card for that particular round beginning with round A and ending with round I. When a round is played and scores tallied, the tiles are returned to the tile bag and mixed for the next round.

The object of the present invention is to form words on playing lines of each successive round, as indicated by the diagramed columns on the game cards. Hence, in round A, six (6) tiles are drawn, as indicated in the DRAW column, with which to form a five (5) letter word, as indicated in the PLAY column.

If in round A, a player forms a five (5) letter word, the player receives as a score the point value of the letters played. A letter falling on a premium circle marked 2 has its value doubled, and a ten (10) point bonus, as indicated in the BONUS column, are awarded for playing five (5) letters thereby "completing the line". If, however, in round A, a player forms only a four (4) or a three (3) letter word, no bonus is awarded. The player receives as a score, the point value of the letters played and the multiple value of whatever letter falls on the premium circle.

As diagramed on the game cards, each round has it own playing and scoring procedure. If a 9, 8, or 7 letter word is formed, the player receives in addition to the premium points, the bonus indicated in the BONUS column. Hence, a nine (9) letter word would receive a fifty (50) point bonus and a seven (7) letter word would receive a five (5) point bonus. This scoring and playing system holds true in all rounds.

The bottom number in the PLAY column of each round indicates the least number of letters played in that round in which a bonus is awarded. A player may begin a word anywhere on the playing line that is advantageous to the score. In no round is a word less than three (3) letters allowed. After each round, the player returns all the tiles to the tile bag.

Each of the rounds (G, H, I) requires the forming of a ten (10) letter word to "complete the line". These rounds become progressively more difficult, as the words are longer and the draw allowances are progressively reduced. The premium circle values and the awarded bonus, however, are significantly increased.

The drawing system for the present invention has been devised to afford the player a more enhanced and flexible band with which to form words.

In each round a player may discard one tile from the draw and exchange it for another. The new tile must be kept and cannot be returned as a duplicate. A bonus tile, however, can be redeemed.

At the outset of each round, a player may return from, and only from, the initial draw all duplicate tiles in excess of two. The new letter or letters must be kept. A bonus tile, however, can be redeemed.

At the outset of each round, a player has an option of returning the initial draw and draw again. The second draw must be kept. The duplicate rule, however, is still in effect.

A blank tile can be used as any letter to form a word but has no point value. A bonus tile is redeemed for two additional tiles. All tiles redeemed from a bonus tile must be kept and cannot be returned or exchanged for any reason. The bonus tile cannot be used as a blank and cannot be returned to the tile bag until the round is over. If in redeeming a bonus tile another bonus tile is drawn, it too can be redeemed.

Before play the players may want to agree upon a dictionary to use as a reference source. All words labeled as parts of speech including those listed as of foreign origin or as archaic, obsolete, colloquial, slang, etc. are allowed with the exception of the following: words always capitalized, abbreviations, prefixes and suffixes standing alone, and words requiring a hyphen or an apostrophe.

The game ends when the I round is completed. At the end of the game, the player with the highest score wins. In the event of a tie, all players play an additional G round until a winner is determined.

A running tally of the score is kept, round by round. The score value of each letter is indicated by the number on the tile. The score of each round is the sum of the letter value or each word formed plus the additional points obtained from placing letters on the premium circles and bonuses awarded as indicated in the BONUS column on the playing cards.

In forming a word, whenever a letter is played on a square with an encircled number, the value of the letter is multiplied by the encircled number. For example, if the number is 2, the value is doubled; if the number is 3, the value is tripled, etc.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

DESCRIPTION OF THE DRAWING

The figures of the drawing are briefly described as follows.

LIST OF REFERENCE NUMERALS UTILIZED IN THE DRAWING

Figure 2:
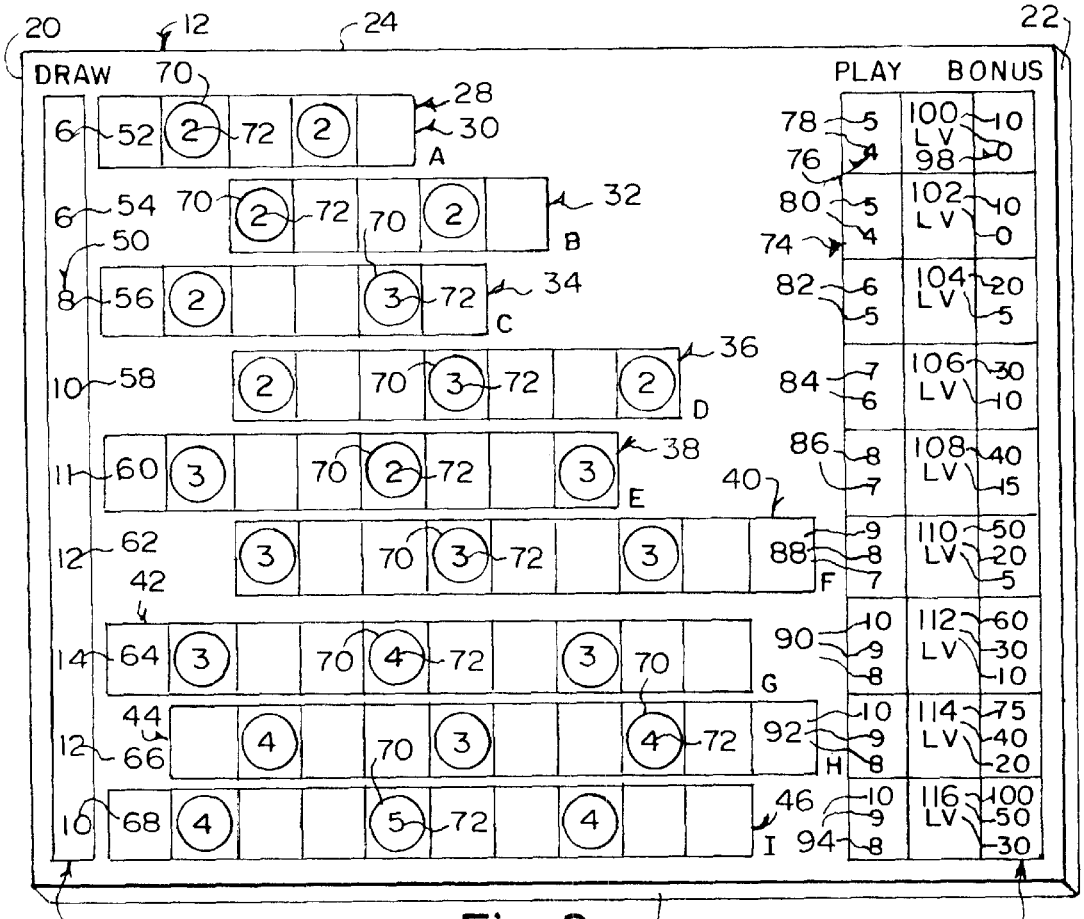
FIG. 2 is an enlarged diagrammatic top plan view of the area generally enclosed by the dotted curve identified by arrow 2 in FIG. 1 of a game card of the apparatus of the game method of the present invention.

10 apparatus of game method of present invention for sharpening anagramming skills
12 four game cards
14 one hundred and three tiles
16 tile bag
18 four optional racks
20 first edge of each card of four game cards 12
22 second side edge of each card of four game cards 12
24 top edge of each card of four game cards 12
26 bottom edge of each card of four game cards 12
28 nine rows of a plurality of playing squares of each card of four game cards 12
30 first row of a plurality of playing squares of nine rows of a plurality of playing squares 28 of each card of four game cards 12
32 second row of a plurality of playing squares of nine rows of a plurality of playing squares 28 of each card of four game cards 12
34 third row of a plurality of playing squares of nine rows of a plurality of playing squares 28 of each card of four game cards 12
36 fourth row of a plurality of playing squares of nine rows of a plurality of playing squares 28 of each card of four game cards 12
38 fifth row of a plurality of playing squares of nine rows of a plurality of playing squares 28 of each card of four game cards 12
40 sixth row of a plurality of playing squares of nine rows of a plurality of playing squares 28 of each card of four game cards 12
42 seventh row of a plurality of playing squares of nine rows of a plurality of playing squares 28 of each card of four game cards 12
44 eighth row of a plurality of playing squares of nine rows of a plurality of playing squares 28 of each card of four game cards 12
46 ninth row of a plurality of playing squares of nine rows of a plurality of playing squares 28 of each card of four game cards 12
48 draw column of each card of four game cards 12
50 nine numbers of draw column 48 of each card of four game cards 12
52 first number of nine numbers 50 of draw column 48 of each card of four game cards 12
54 second number of nine numbers 50 of draw column 48 of each card of four game cards 12
56 third number of nine numbers 50 of draw column 48 of each card of four game cards 12
58 fourth number of nine numbers 50 of draw column 48 of each card of four game cards 12
60 fifth number of nine numbers 50 of draw column 48 of each card of four game cards 12
62 sixth number of nine numbers 50 of draw column 48 of each card of four game cards 12
64 seventh number of nine numbers 50 of draw column 48 of each card of four game cards 12
68 eight number of nine numbers 50 of draw column 48 of each card of four game cards 12
68 ninth number of nine numbers 50 of draw column 48 of each card of four game cards 12
70 at least two premium circles of each row of nine rows of a plurality of playing squares 28 of each card of four game cards 12
72 number in each circle of at least two premium circles 70 of each row of nine rows of a plurality of playing squares 28 of each card of four game cards 12
74 play column of each card of four game cards 12
76 eighteen numbers of play column 74 of each card of four game cards 12
78 first at least a pair of numbers of eighteen numbers of play column 74 of each card of four game cards 12
80 second at least a pair of numbers of eighteen numbers of play column 74 of each card of four game cards 12
82 third at least a pair of numbers of eighteen numbers of play column 74 of each card of four game cards 12
84 fourth at least a pair of numbers of eighteen numbers of play column 74 of each card of four game cards 12
86 fifth at least a pair of numbers of eighteen numbers of play column 74 of each card of four game cards 12
88 sixth at least a pair of numbers of eighteen number of play column 74 of each card of four game cards 12
90 seventh at least a pair of numbers of eighteen numbers of play column 74 of each card of four game cards 12
92 eighth at least a pair of numbers of eighteen numbers of play column 74 of each card of four game cards 12
94 ninth at least a pair of numbers of eighteen numbers of play column 74 of each card of four game cards 12
96 bonus column of each card of four game cards 12
98 eighteen numbers of bonus column 96 of each card of four game cards 12
100 first at least a pair of numbers 100 of eighteen numbers 98 of bonus column 96 of each card of four game cards 12
102 second at least a pair of numbers of eighteen numbers 98 of bonus column 96 of each card of four game cards 12
104 third at least a pair of numbers of eighteen numbers 98 of bonus column 96 of each card of four game cards 12
106 fourth at least a pair of numbers of eighteen numbers 98 of bonus column 96 of each card of four game cards 12
108 fifth at least a pair of numbers of eighteen numbers 98 of bonus column 96 of each card of four game cards 12
110 sixth at least a pair of numbers of eighteen numbers 98 of bonus column 96 of each card of four game cards 12
112 seventh at least a pair of numbers of eighteen numbers 98 of bonus column 96 of each card of four game cards 12
114 eighth at least a pair of numbers of eighteen numbers 98 of bonus column 96 of each card of four game cards 12
116 ninth at least a pair of numbers of eighteen numbers 98 of bonus column 96 of each card of four game cards 12
118 ninety-six lettered tiles of one hundred and three tiles 14
120 four blank tiles of one hundred and three tiles 14
122 three bonus tiles of one hundred and three tiles 14

DESCRIPTION OF THE PREFERRED EMBODIMENT

Figure 1:
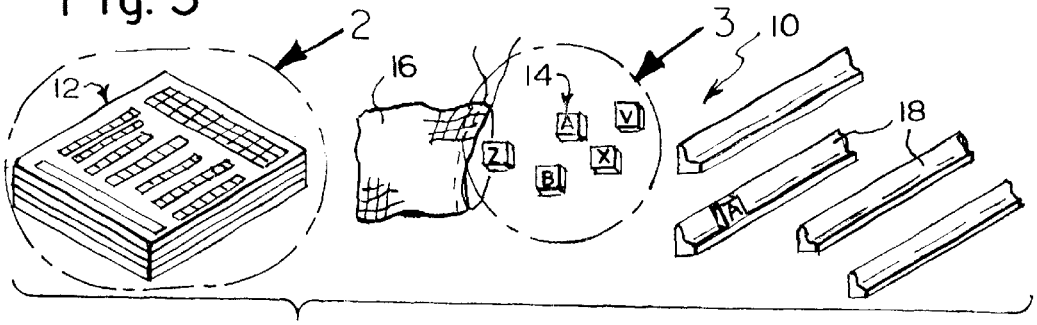
FIG. 1 is an exploded diagrammatic perspective view of the apparatus of the game method of the present invention.

Referring now to the figures, in which like numerals indicate like parts, and particularly to FIG. 1, the apparatus of the game method of the present invention is shown generally at 10 for sharpening anagramming skills.

The apparatus 10 comprises four game cards 12 that are identical to each other, one hundred and three tiles 14 that are selectively positioned on at least one of the four game cards 12, a tile bag 16 that holds the one hundred and three tiles 14, and four optional racks 18 that hold selective portions of the one hundred and three tiles 14.

The specific configuration of each one of the four game cards 12 can best be seen in FIG. 2, and as such, will be discussed with reference thereto.

Each one of the four game cards 12 is generally square-shaped and has a first side edge 20, a second side edge 22, a top edge 24, and a bottom edge 26.

Each one of the four game cards 12 further bas nine rows of a plurality of playing squares 28 that constitute nine rounds of play which include a first round of play, a second round of play, a third round of play, a fourth round of play, a fifth round of play, a sixth round of play, a seventh round of play, an eighth round of play, and a ninth round of play.

The nine rows of a plurality of playing squares 28 are independent of each other and extend from approximately the first side edge 20 to approximately the second side edge 22, and are spaced-apart from each other from approximately the top edge 24 to approximately the bottom edge 26.

The nine rows of a plurality of playing squares 28 comprise a first row of a plurality of playing squares 30, a second row of a plurality of 3e playing squares 32, a third row of a plurality of playing squares 34, a fourth row of a plurality of playing squares 36, a fifth row of a plurality of playing squares 38, a sixth row of a plurality of playing squares 40, a seventh row of a plurality of playing squares 42, an eighth row of a plurality of playing squares 44, and a ninth row of a plurality of playing squares 46.

The first row of a plurality of playing squares 30 is divided into five playing squares, the second row of a plurality of playing squares 32 is divided into five playing squares, the third row of a plurality of playing squares 34 is divided into six playing squares, the fourth row of a plurality of playing squares 36 is divided into seven playing squares, the fifth row of a plurality of playing squares 38 is divided into eight playing squares, the sixth row of a plurality of playing squares 40 is divided into nine playing squares, the seventh row of a plurality of playing squares 42 is divided into ten playing squares, the eighth row of a plurality of playing squares 44 is divided into ten playing squares, and the ninth row of a plurality of playing squares 46 is divided into ten playing squares.

Each one of the four game cards 12 further bas a draw column 48 that extends from approximately the top edge 24 to approximately the bottom edge 28, and is disposed between the first side edge 20 and the nine rows of a plurality of playing squares 28.

The draw column 48 has nine numbers 50 extending independently therealong and which are positioned adjacent the nine rows of a plurality of playing squares 28, respectively. Each of the nine numbers 50 corresponds to a number of the tiles 14 to be drawn by a player when the player is playing a round of play of the nine rounds of play adjacent thereto.

The nine numbers 50 comprise a first number 52 which is six which indicates that six tiles are to be drawn by a player when the player is playing the first round, a second number 54 which is six which indicates that six tiles are to be drawn by a player when the player is playing the second round, a third number 56 which is eight which indicates that eight tiles are to be drawn by a player when the player is playing the third round, a fourth number 58 which is ten which indicates that ten tiles are to be drawn by a player when the player is playing the fourth round, a fifth number 60 which is eleven which indicates that eleven tiles are to be drawn by a player when the player is playing the fifth round, a sixth number 62 which is twelve which indicates that twelve tiles are to be drawn by a player when the player is playing the sixth round, a seventh number 64 which is fourteen which indicates that fourteen tiles are to be drawn by a player when the player is playing the seventh round, an eighth number 66 which is twelve which indicates that twelve tiles are to be drawn by a player when the player is playing the eighth round, and a ninth number 68 which is ten which indicates that ten tiles are to be drawn by a player when the player is playing the ninth round.

Each one of the nine rows of a plurality of playing squares 28 has at least two premium circles 70 in associated playing squares. Each of the at least two premium circles 70 of each one of the nine rows of a plurality of playing squares 28 has a number 72 therein. The number 72 indicates a multiple of value of a tile positioned thereon.

The first row of a plurality of playing squares 30 has two of the at least two premium circles 70 in a second and a fourth playing square thereof, respectively, and the numbers 72 therein are two and two, respectively.

The second row of a plurality of playing squares 32 has two of the at least two premium circles 70 in a first and a fourth playing square thereof, respectively, and the numbers 72 therein are two and two, respectively.

The third row of a plurality of playing squares 34 has two of the at least two premium circles 70 in a second and a fifth playing square thereof, respectively, and the numbers 72 therein are two and three, respectively.

The fourth row of a plurality of playing squares 36 has three of the at least two premium circles 70 in a first, a fourth, and a seventh playing square thereof, respectively, and the numbers 72 therein are two, three, and two, respectively.

The fifth row of a plurality of playing squares 38 has three of the at least two premium circles 70 in a second, a fifth, and an eighth playing square thereof, respectively, and the numbers 72 therein are three, two, and three respectively.

The sixth row of a plurality of playing squares 40 has three of the at least two premium circles 70 in a first, a fourth, and a seventh playing square thereof, respectively, and the numbers 72 therein are three, three, and three respectively.

The seventh row of a plurality of playing squares 42 has three of the at least two premium circles 76 in a second, a fifth, and an eighth playing square thereof, respectively, and the numbers 72 therein are three, four, and three respectively.

The eighth row of a plurality of playing as 44 has three of the at least two premium circles 70 in a second, a fifth, and an eighth playing square thereof, respectively, and the numbers 72 therein are four, three, and four respectively.

The ninth row of a plurality of playing squares 46 has three of the at least two premium circles 70 in a second, a fifth, and an eighth playing square thereof, respectively, and the numbers 72 therein are four, five, and four respectively.

Each one of the four game cards 12 further has a play column 74 that extends from approximately the top edge 24 to approximately the bottom edge 26, and is disposed between the second side edge 22 and the nine rows of a plurality of playing squares 28.

The play column 74 has eighteen numbers 76 extending independently therealong and at least a pair of which are positioned adjacent the nine rows of a plurality of playing squares 28, respectively. Each at least a pair of numbers of the eighteen numbers 76 corresponds to a number of the tiles 14 used by a player when the player is playing an associated of play of the nine rounds of play adjacent thereto that qualifies the player for a bonus.

The eighteen numbers 76 comprise a first at least a pair of numbers 78 that are five and four and which indicate that if five or four tiles are used by a player when the player is playing the first round the player qualifies for a bonus, a second at least a pair of numbers 80 that are five and four and which indicate that if five or four tiles are used by a player when the player is playing the second round the player qualifies for a bonus, a third at least a pair of numbers 82 that are six and five and which indicate that if six or five tiles are used by a player when the player is playing the third round the player qualifies for a bonus, a fourth at least a pair of numbers 84 that are seven and six and which indicate that if seven or six tiles are used by a player when the player is playing the fourth round the player qualifies for a bonus, a fifth at least a pair of numbers 88 that are eight and seven and which indicate that if eight or seven tiles are used by a player when the player is playing the fifth round the player qualifies for a bonus, a sixth at least a pair of numbers 88 that are nine, eight, and seven and which indicate that if nine, eight, or seven tiles are used by a player when the player is playing the sixth round the player qualifies for a bonus, a seventh at least a pair of numbers 90 that are ten, nine, and eight and which indicate that if ten, nine, or eight tiles are used by a player when the player is playing the seventh round the player qualifies for a bonus, an eighth at least a pair of numbers 92 that are ten, nine, and eight and which indicate that if ten, nine, or eight tiles are used by a player when the player is playing the eighth round the player qualifies for a bonus, and a ninth at least a pair of numbers 94 that are ten, nine, and eight and which indicate that if ten, nine, or eight tiles are used by a player when the player is playing the ninth round the player qualifies for a bonus.

Each one of the four game cards 12 further has a bonus column 96 that extends from approximately the top edge 24 to approximately the bottom edge 26, and is disposed between the second side edge 22 and the play column 74.

The bonus column 96 has eighteen numbers 98 extending independently therealong and at least a pair of which are positioned adjacent the at least a pair of numbers of the play column 74, respectively. Each at least a pair of numbers of the eighteen numbers 98 of the bonus column 96 corresponding to the at least a pair of numbers of the eighteen numbers 76 of the play column 74 indicated the bonus.

The eighteen numbers 98 of the bonus column 98 comprise a first at least a pair of numbers 100 that are ten and zero and which indicate that if five or four tiles are used by a player when the player is playing the first round the player qualifies for a bonus of ten or zero, respectively, a second at least a pair of numbers 102 that are ten and zero and which indicate that if five or four tiles are use by a player when the player is playing the second round the player qualifies for a bonus of ten or zero, respectively, a third at least a pair of numbers 104 that are twenty and five and which indicate that if six or five tiles are used by, a player when the player is playing the third round the player qualifies for a bonus of twenty or five, respectively, a fourth at least a pair of numbers 106 that are thirty and ten and which indicate that if seven or six tiles are used by, a player when the player is playing the fourth round the player qualifies for a bonus of thirty, or ten, respectively, a fifth at least a pair of numbers 108 that are forty and fifteen and which indicate that if eight or seven tiles are used by a player when the player is playing the fifth round the player qualifies for a bonus of forty or fifteen, respectively, a sixth at least a pair of numbers 100 that are fifty, twenty, and five and which indicate that if nine, eight, or seven tiles are used by a player when the player is playing the sixth round the player qualifies for a bonus of fifty, twenty, or five, respectively, a seventh at least a pair of numbers 112 that are sixth, thirty, and ten and which indicate that if ten, nine, or eight tiles are used by a player when the player is playing the seventh round the player qualifies for a bonus of sixty, thirty, or ten, respectively, an eighth at least a pair of numbers 114 that are seventy-five, forty, and twenty and which indicate that if ten, nine, or eight tiles are used by a player when the player is playing the eighth round the player qualifies for a bonus of seventy-five, forty, or twenty, respectively, and a ninth at least a pair of numbers 116 that are one hundred, fifty, and thirty and which indicate that if ten, nine, or eight tiles are used by a player when the player is playing the ninth round the player qualifies for a bonus of one hundred, fifty, or thirty, respectively.

Figure 3:
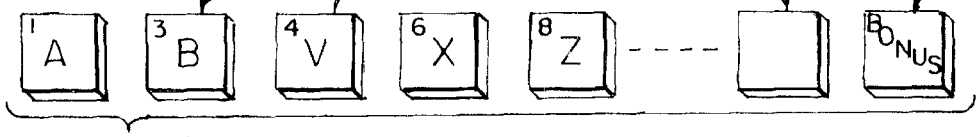
FIG. 3 is an enlarged exploded diagrammatic top plan view of the area generally enclosed by the dotted curve identified by arrow 2 in FIG. 1 of the tiles of the apparatus of the game method of the present invention.

The specific configuration of the one hundred and three tiles 14 can best be seen in FIG. 3, and as such, will be discussed with reference thereto.

The one hundred and three tiles 14 comprise ninety-six lettered tiles 118, four blank tiles 120, and three bonus tiles 122.

Each of the four blank tiles 120 is used as any letter to form a word but has no point value. Each of the three bonus tiles 122 is redeemable for two additional tiles. The three bonus tiles 122 are not interchangeable with the four blank tiles 120.

Figure 4A:
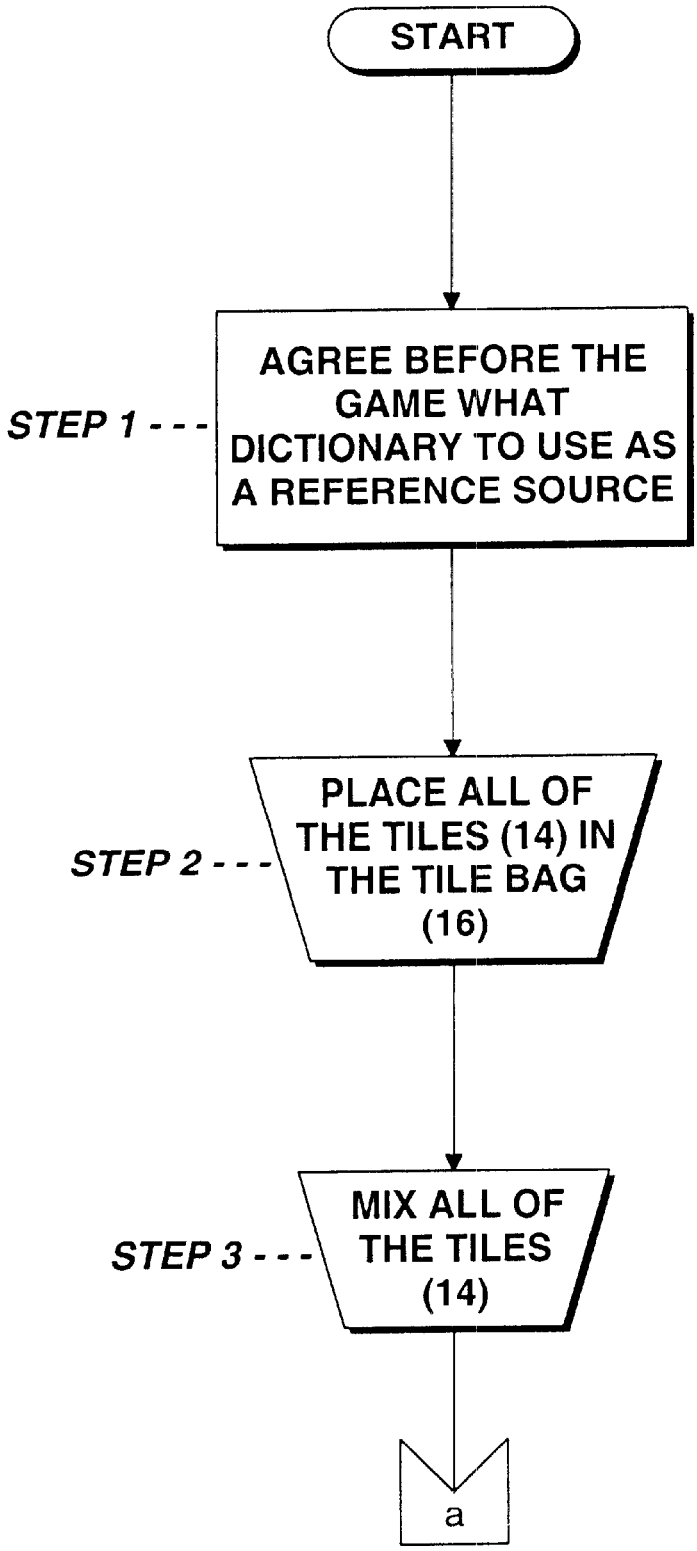
FIGS. 4A–4W are a flow chart of the game method of the present invention.
Figure 4B:
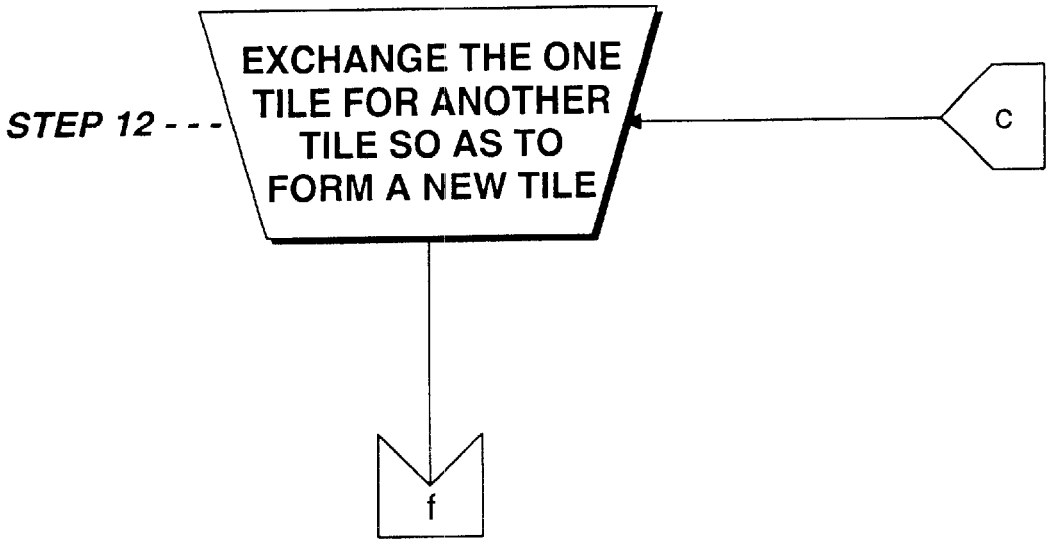
Figure 4C:
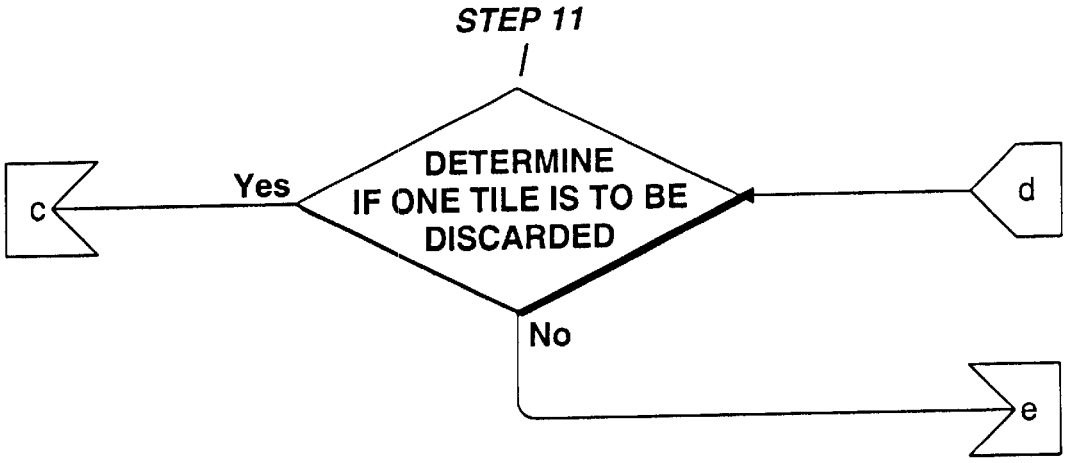
Figure 4D:
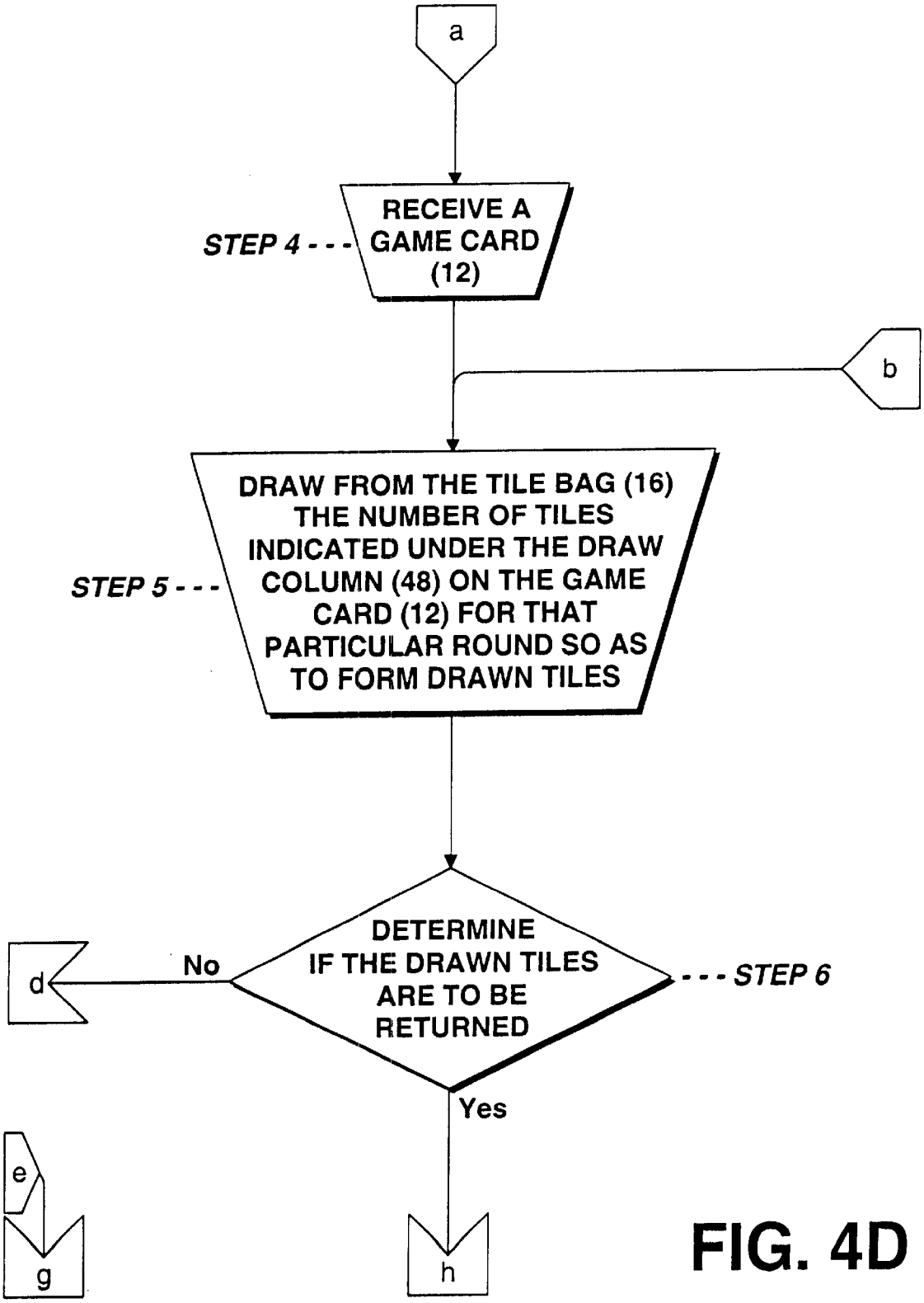
Figure 4E:
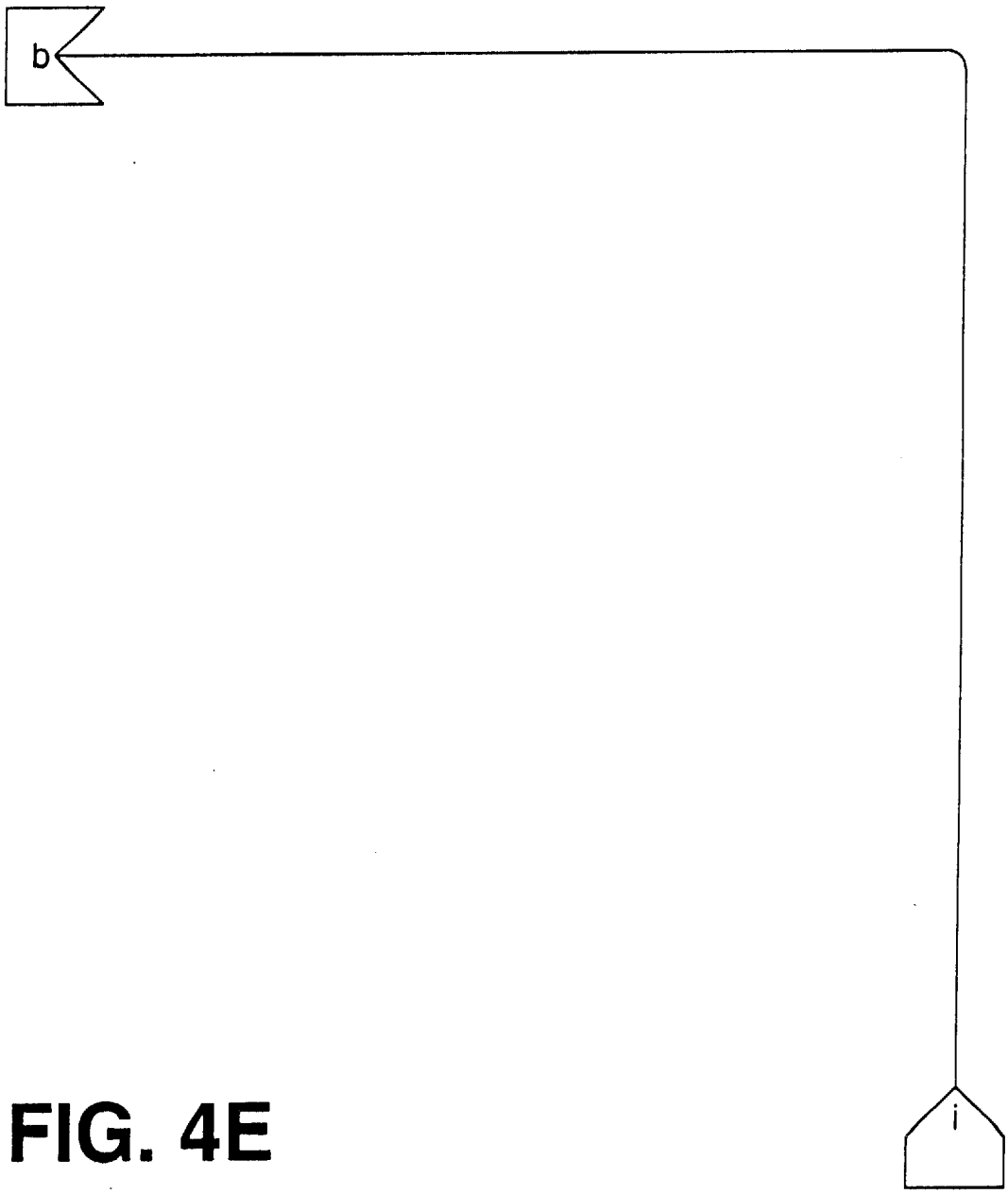
Figure 4F:
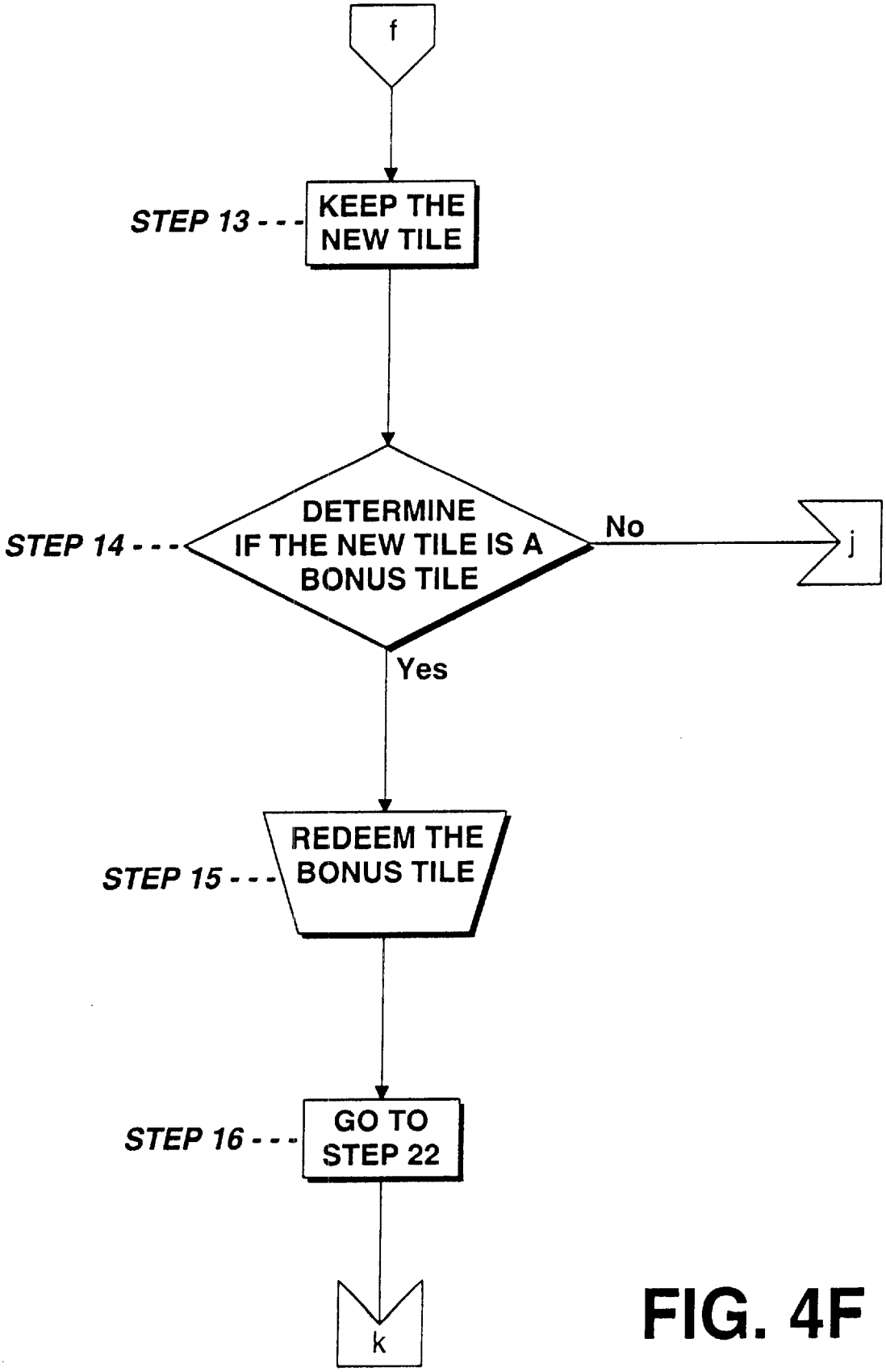
Figure 4G:
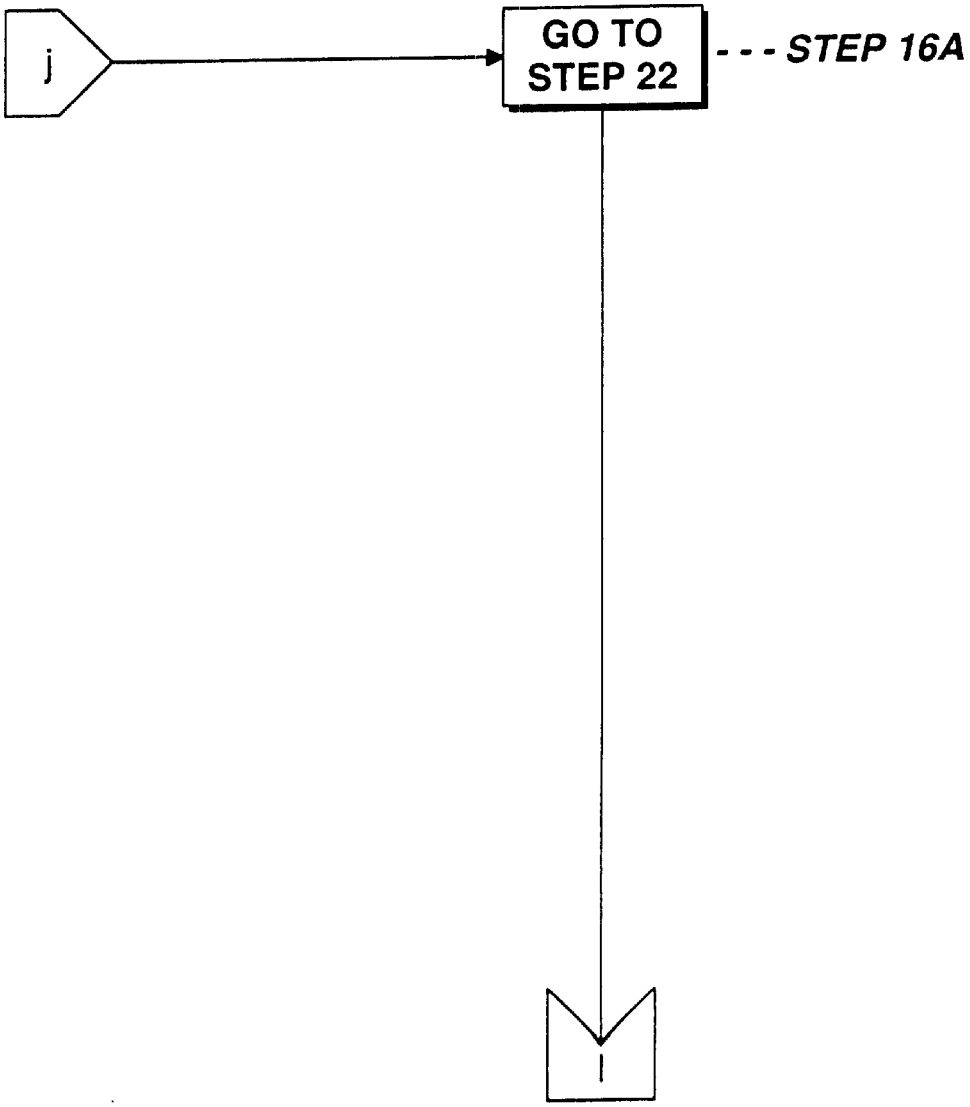
Figure 4H:
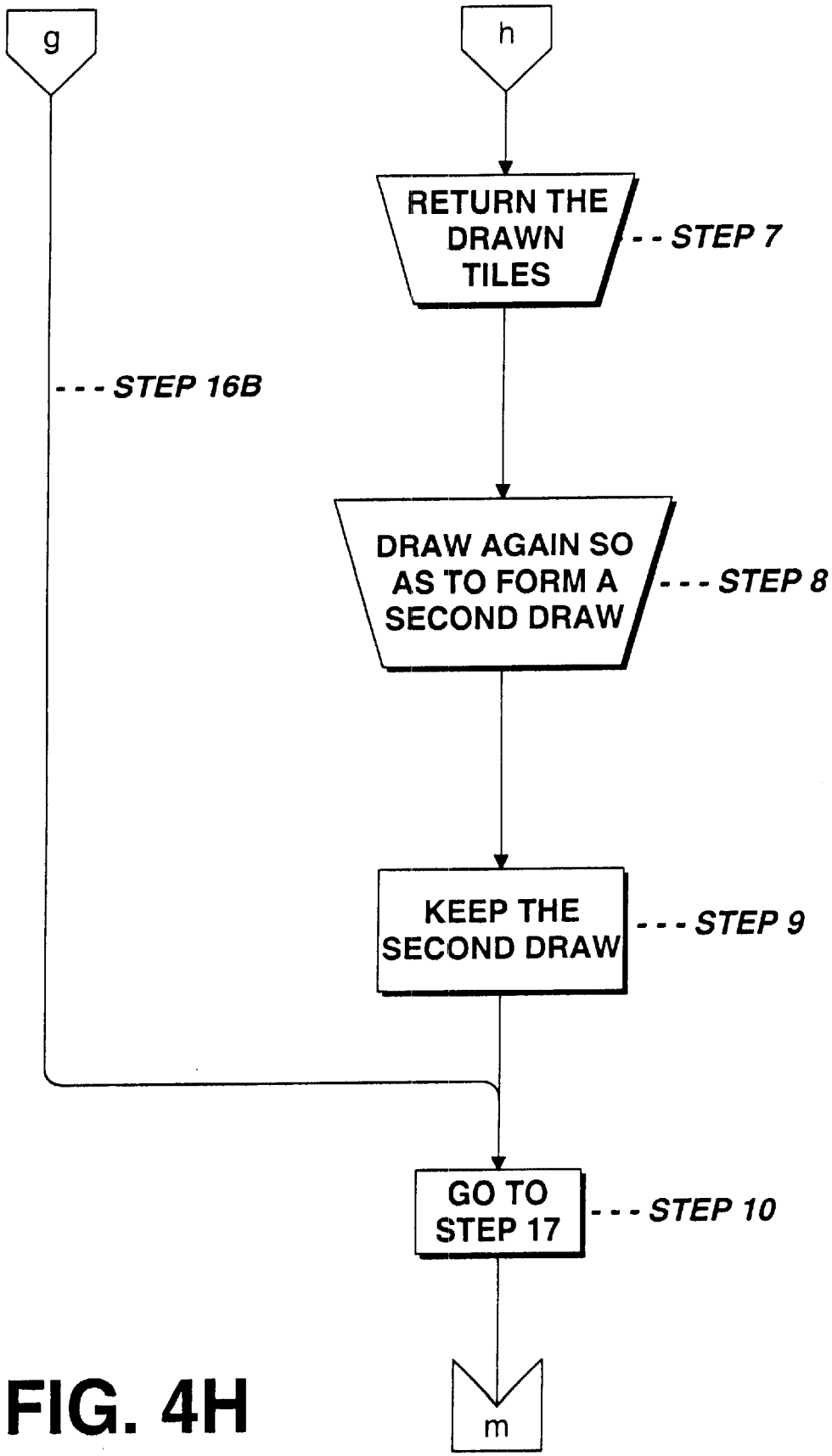
Figure 4I:
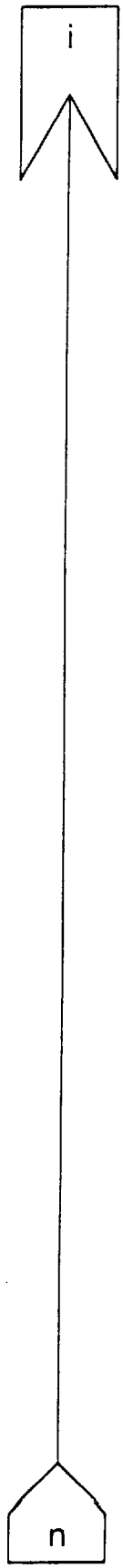
Figure 4J:
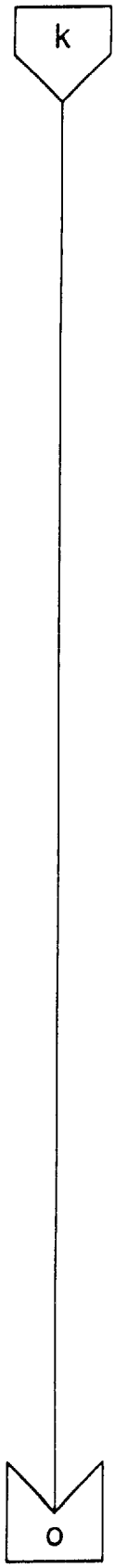
Figure 4K:
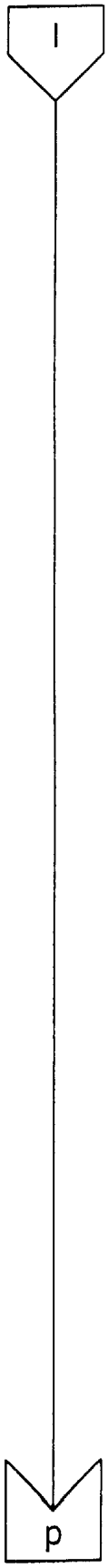
Figure 4L:
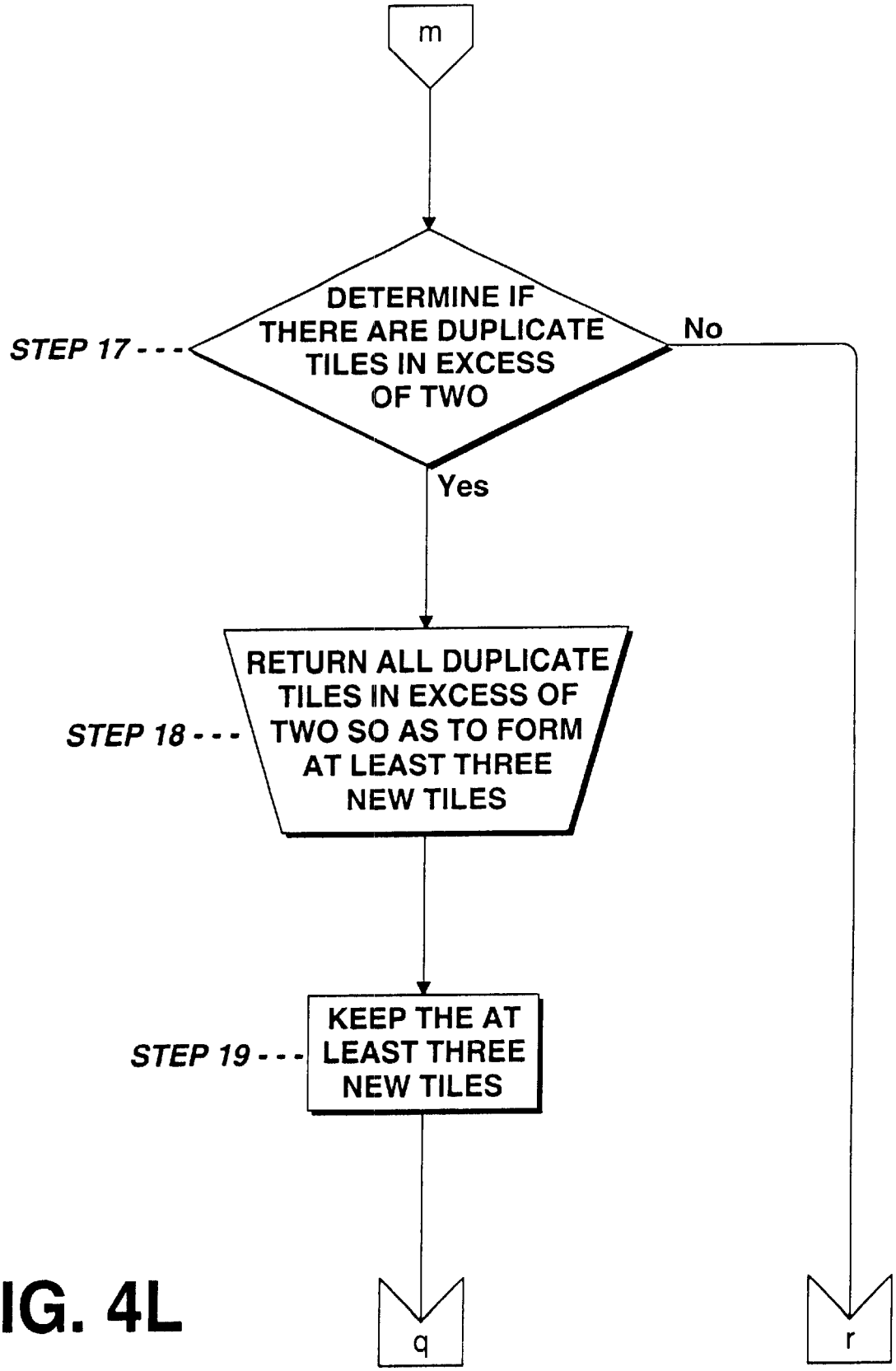
Figure 4M:
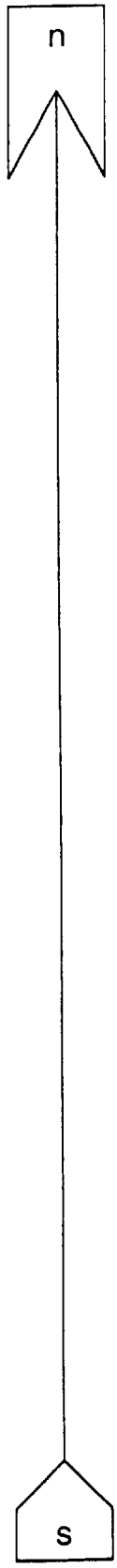
Figure 4N:
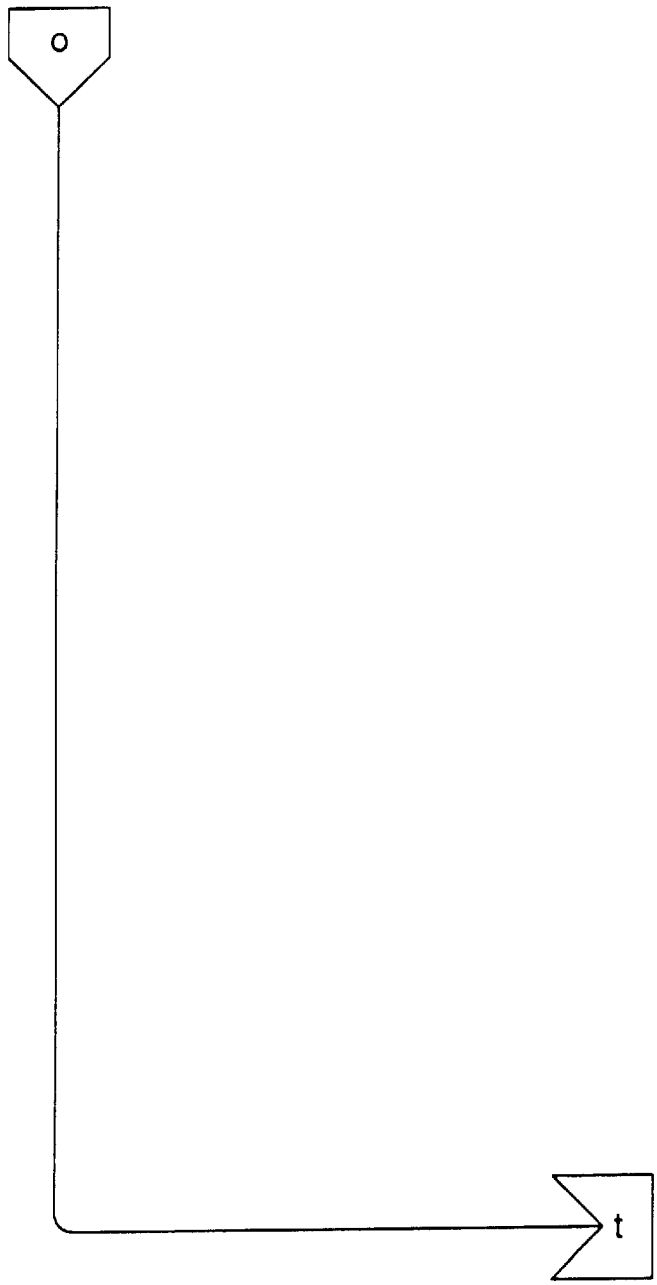
Figure 4O:
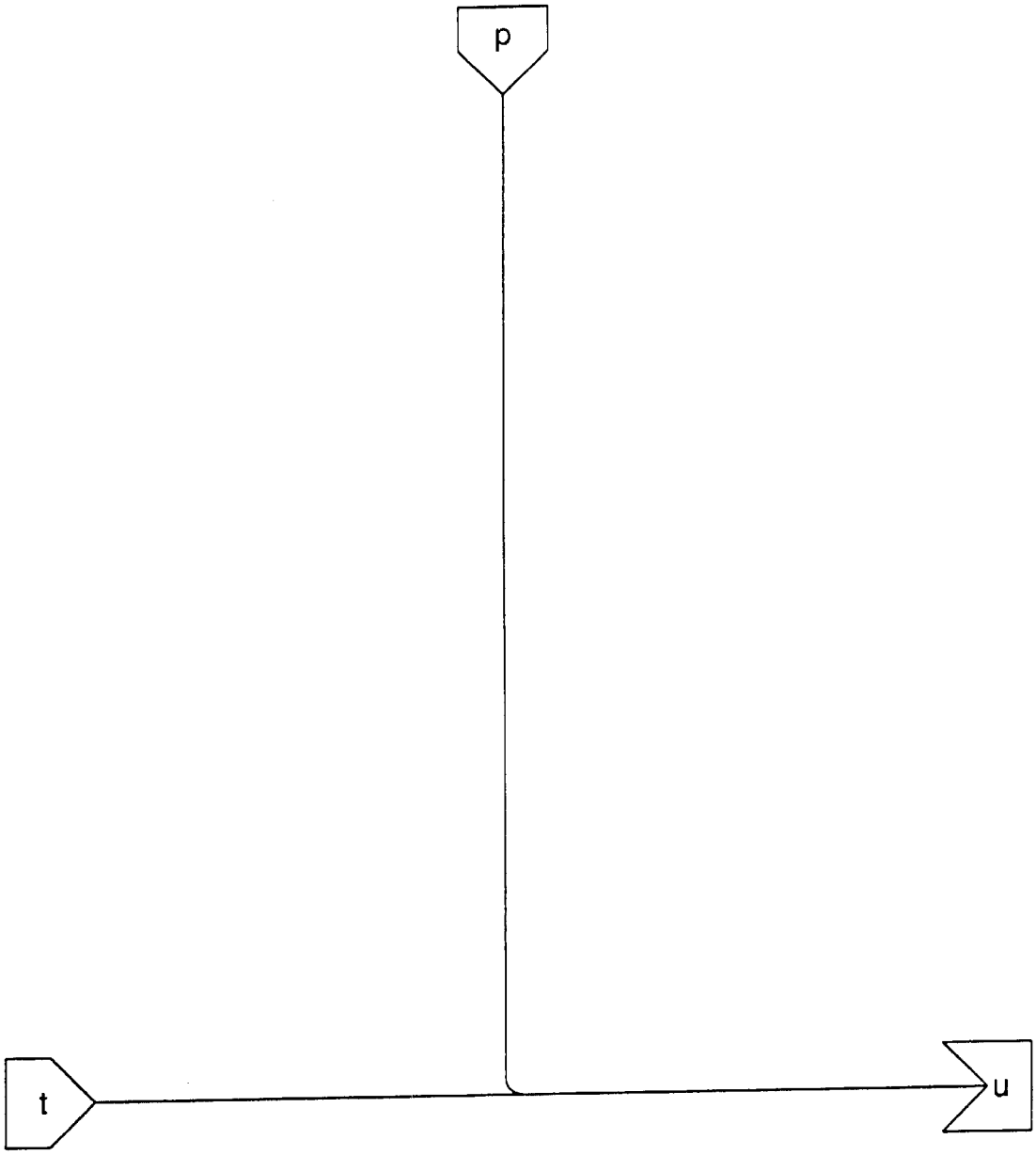
Figure 4P:
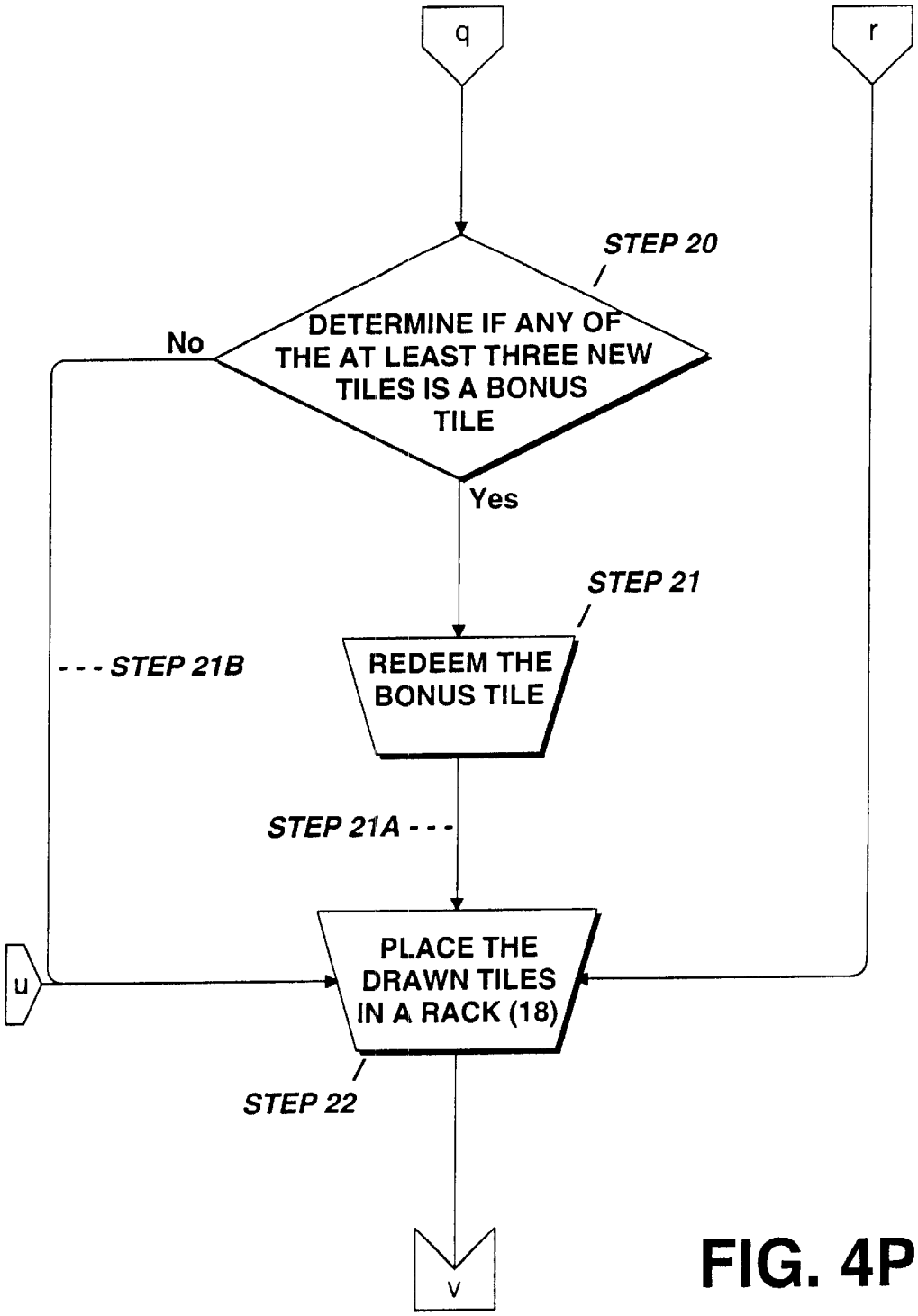
Figure 4Q:
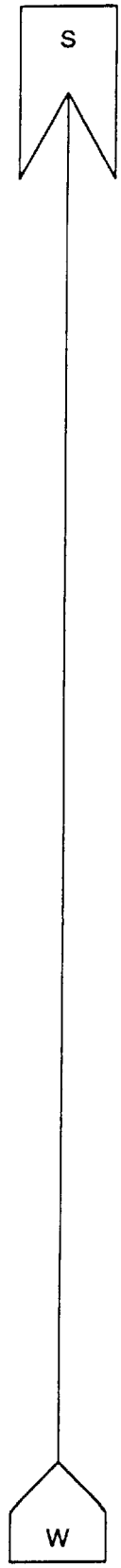
Figure 4R:
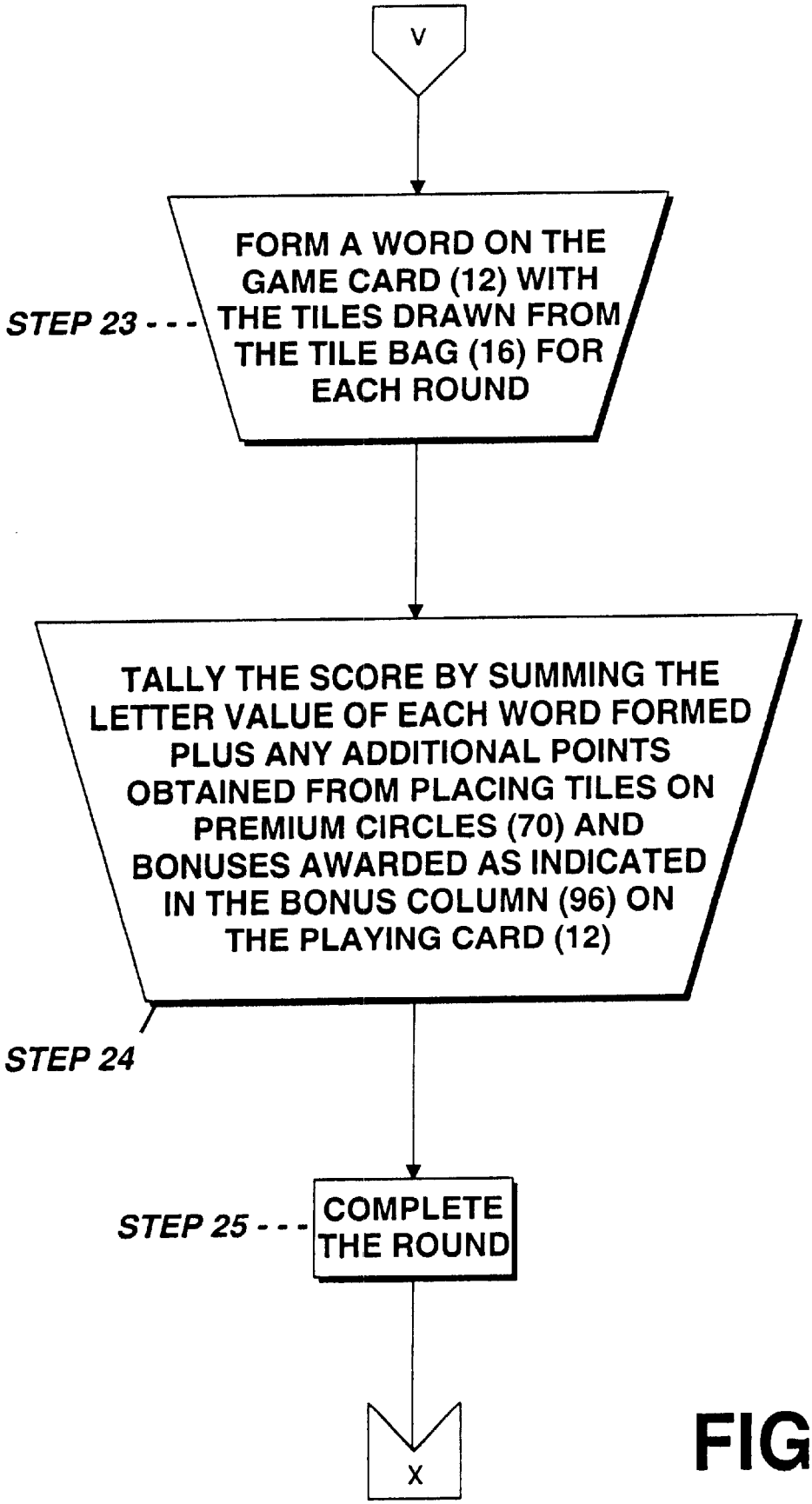
Figure 4S:
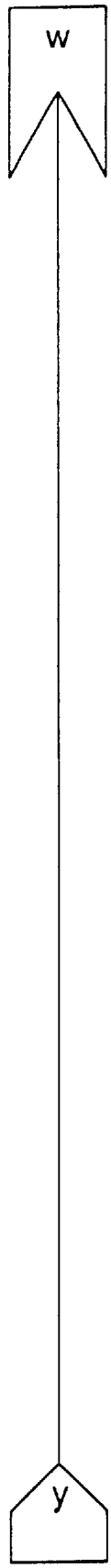
Figure 4T:
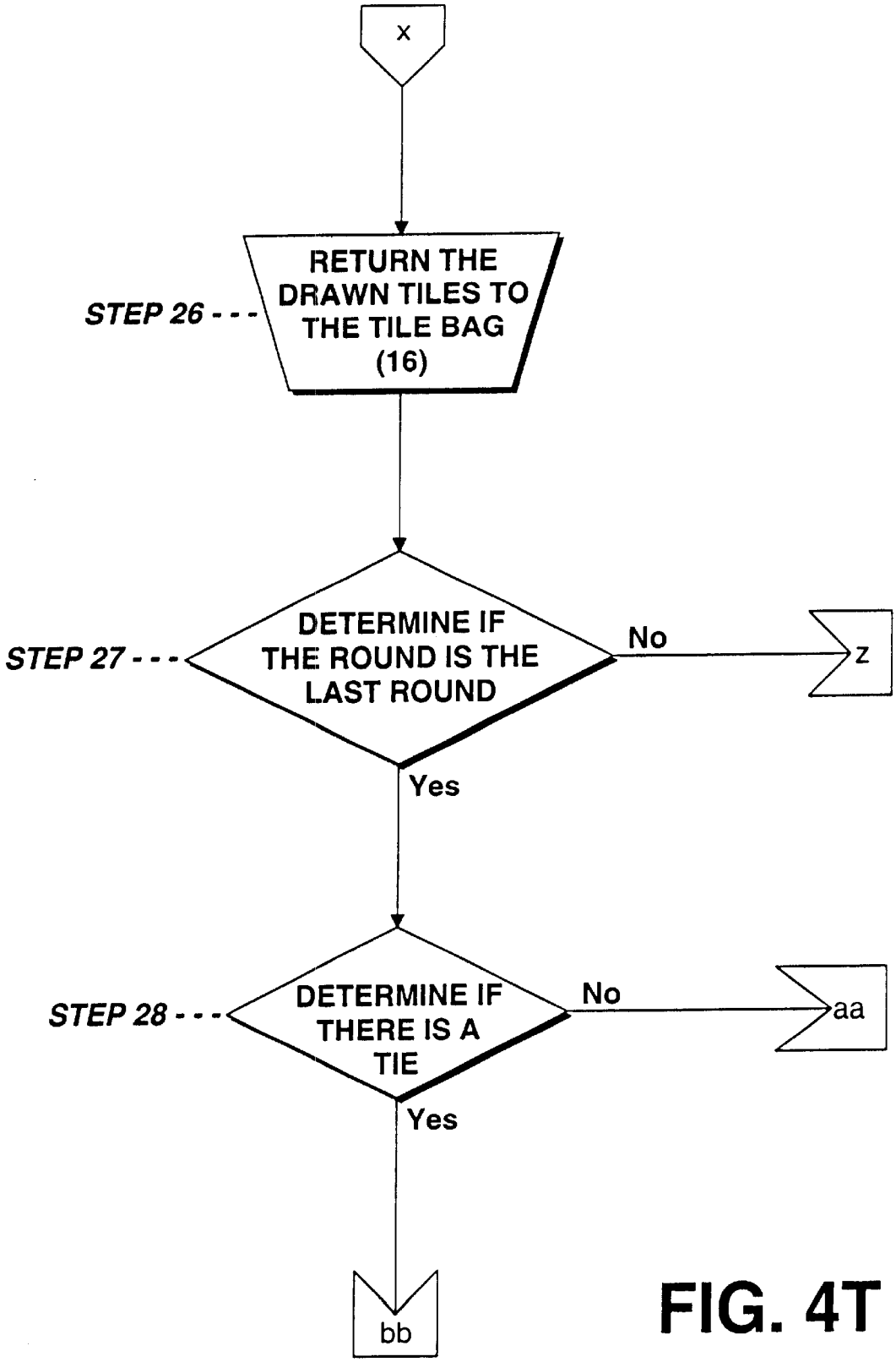
Figure 4U:
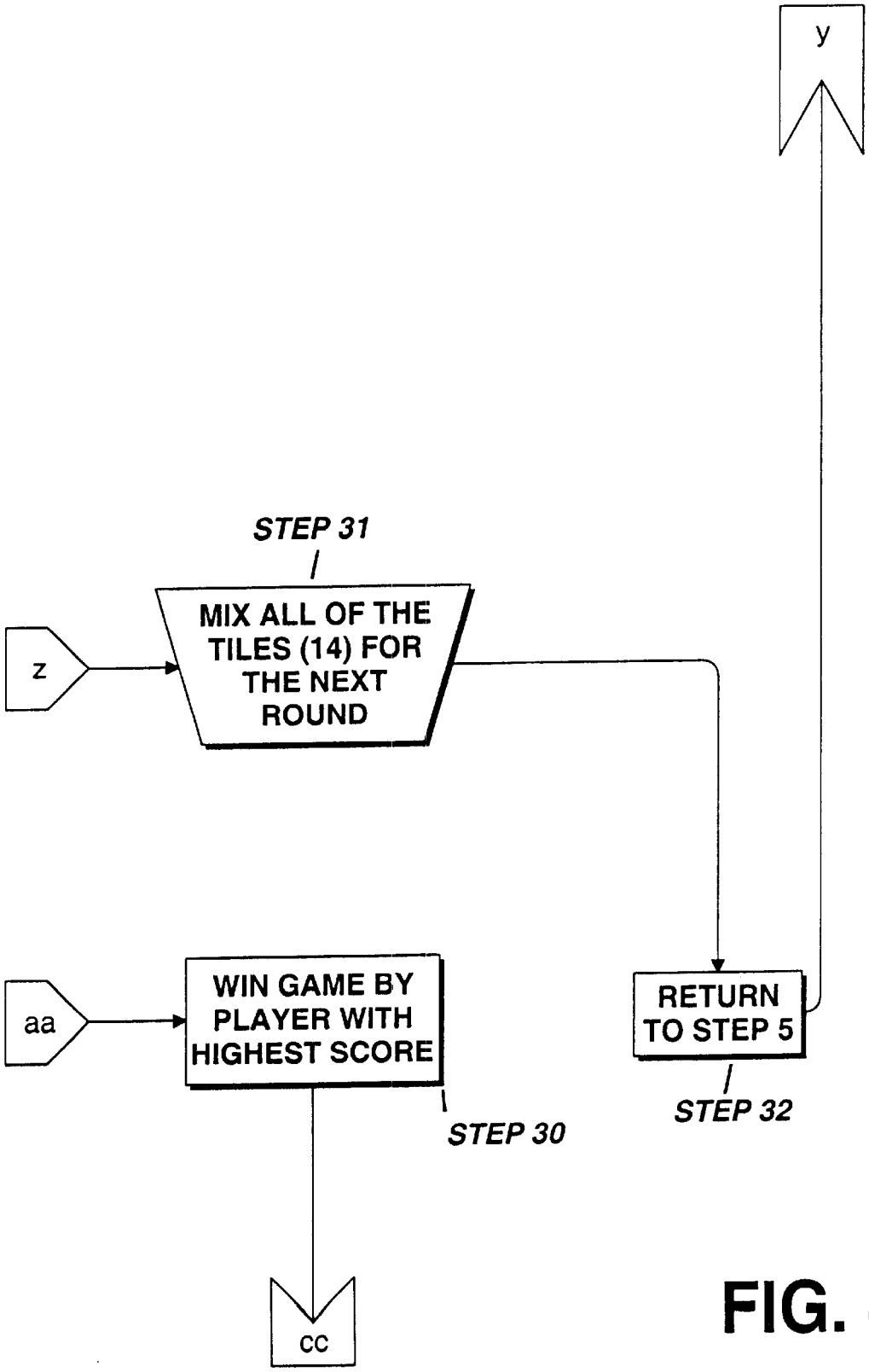
Figure 4V:
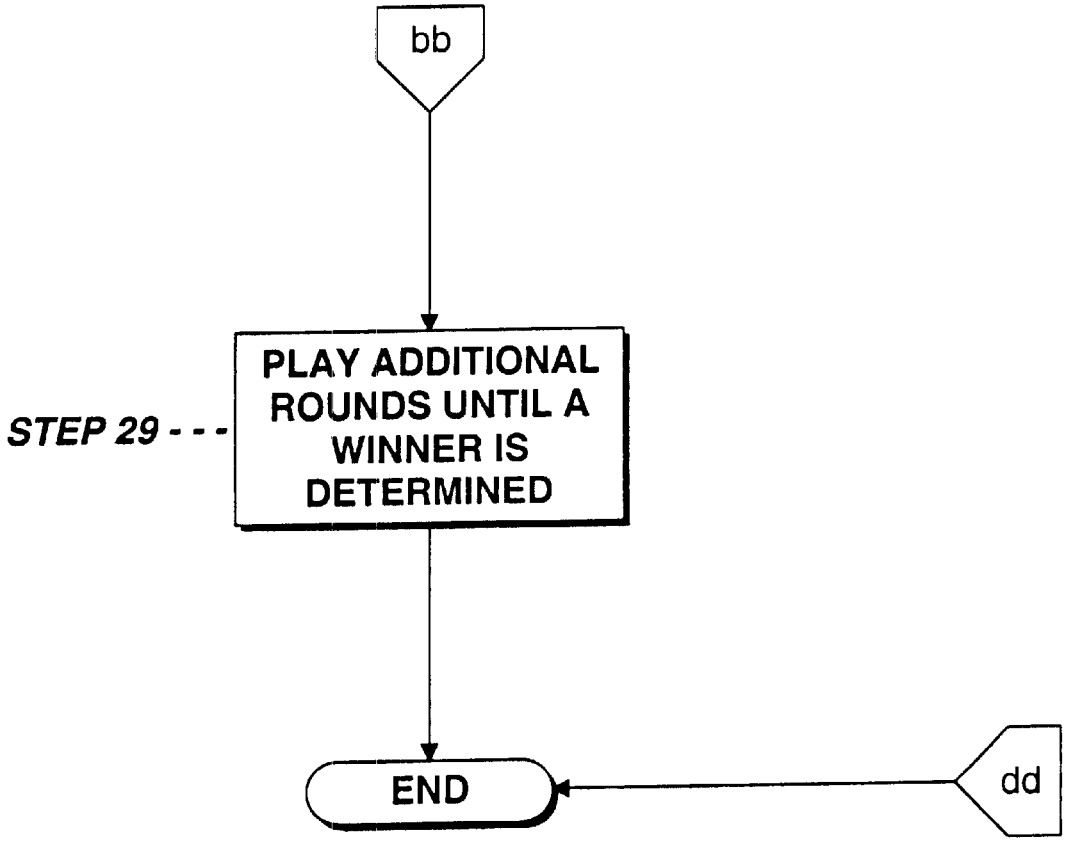
Figure 4W:
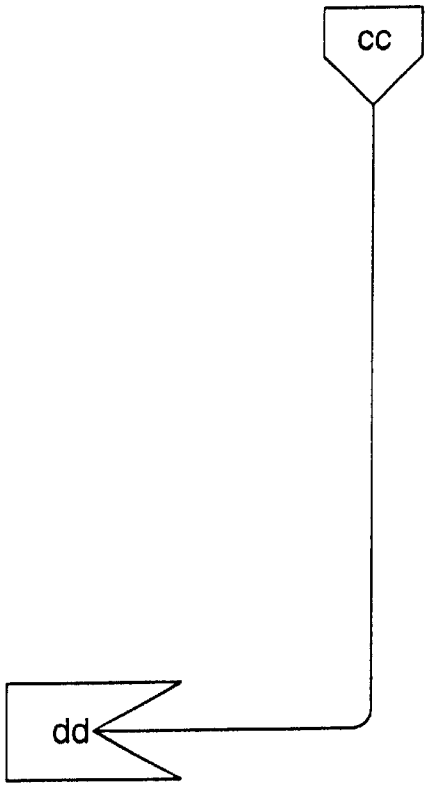

The game method for sharpening anagramming skills can best be seen in FIGS. 4A–4W, and as such, will be discussed with reference thereto.

STEP 1: Agree before the game what dictionary to use as a reference source, wherein all words labeled as parts of speech, including those listed as of foreign origin or as archaic, obsolete, colloquial, slang, etc., Are allowed with exception of words always capitalized, abbreviations, prefixes and suffixes standing alone, and words requiring a hyphen or an apostrophe.

STEP 2: Place all of the tiles 14 in the tile bag 16, wherein the tiles 14 comprise 130 tiles including 96 lettered tiles, 4 blank tiles, and 3 bonus tiles, wherein a blank tile can be used as any letter to form a word but has no point value, a bonus tile is redeemed for two additional tiles, with all tiles redeemed from a bonus tile being kept and not be returned or exchanged for any reason wherein the bonus tile cannot be used as a blank and cannot be returned to the tile bag until the round is over, if in redeeming a bonus tile another bonus tile is drawn, it too can be redeemed.

STEP 3: Mix all of the tiles 14.

STEP 4: Receive a game card 12.

STEP 5: Draw from the tile bag 16 the number of the tiles indicated under the draw column 48 on the game card 12 for that particular round so as to form drawn tiles.

STEP 6: Determine if the drawn tiles are to be returned.

STEP 7: Return the drawn tiles if answer to step 6 is yes.

STEP 8: Draw again so as to form a second draw if step 7 is carried out.

STEP 9: Keep the second draw if step 8 is carried out.

STEP 10: Go to step 17 if step 9 is carried out.

STEP 11: Determine if one tile is to be discarded if answer to step 6 is no.

STEP 12: Exchange the one tile for another tile so as to form a new tile if answer to step 11 is yes.

STEP 13: Keep the new tile if step 12 is carried out.

STEP 14: Determine if the new tile is a bonus tile if step 13 is carried out.

STEP 15: Redeem the bonus tile if answer to step 14 is yes.

STEP 16: Go to step 22 if step 15 is carried out.

STEP 16A: Go to step 22 if answer to step 14 is no.

STEP 16B: Go to step 17 if answer to step 11 is no.

STEP 17: Determine if there are duplicate tiles in excess of two.

STEP 18: Return all duplicate tiles in excess of two so as to form at least three new tiles if answer to step 17 is yes.

STEP 19: Keep the at least three new tiles if step 18 is carried out.

STEP 20: Determine if any of the at least three new tiles is a bonus tile if step 19 is carried out.

STEP 21: Redeem the bonus tile if answer to step 20 is yes.

STEP 21A: Go to step 22 if step 21 is carried out.

STEP 21B: Go to step 22 if answer to step 20 is no.

STEP 22: Place the drawn tiles in a rack 18.

STEP 23: Form a word on the game card 12 with the tiles drawn from the tile bag 16 for each round, wherein in no round is a word less than three (3) letters allowed, with which to form a five (5) letter word (as indicated in the play column). Words can be started any place on the line.

STEP 24: Tally the score by summing the letter value of each word formed plus any additional points obtained from placing letters on premium circles 70 and bonuses awarded as indicated in the bonus column 96 on the playing card 12.

STEP 25: Complete the round.

STEP 26: Return the drawn tiles to the tile bag 16.

STEP 27: Determine if the round is the last round.

STEP 28: Determine if there is a tie if answer to step 27 is yes.

STEP 29: Play additional rounds until a winner is determined if answer to step 28 is yes.

STEP 30: Win game by player with highest score if answer to step 28 is no.

STEP 31: Mix all of the tiles 14 for the next round if step 29 is carried out.

STEP 32: Return to step 5 if step 31 is carried out.

It will be understood that each of the elements described above, or two or more together, may also find a useful application in other types of constructions differing from the types described above.

While the invention has been illustrated and described as embodied in a game method for sharpening anagramming skills and apparatus therefor, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed in:

1. An apparatus for sharpening anagramming skills, comprising:

a) at least one game card;

b) a plurality of tiles; and c) a tile bag;

wherein said plurality of tiles are selectively positioned on said at least one game card; and wherein said tile bag holds said plurality of tiles, wherein said at least one game card is generally square-shaped;

wherein said at least one game card has a first side edge;

wherein said at least one game card has a second side edge;

wherein said at least one game card has a top edge; and wherein said at least one game card has a bottom edge, wherein said at least one game card has nine rows of a plurality of playing squares;

wherein said nine rows of a plurality of playing squares constitute nine rounds of play;

wherein said nine rounds of play include a first round of play;

wherein said nine rounds of play include a second round of play;

wherein said nine rounds of play include a third round of play;

wherein said nine rounds of play include a fourth round of play;

wherein said nine rounds of play include a fifth round of play;

wherein said nine rounds of play include a sixth round of play;

wherein said nine rounds of play include a seventh round of play:

wherein said nine rounds of play include an eighth round of play; and wherein said nine rounds of play include a ninth round of play, wherein each one of said nine rows of a plurality of playing squares has at least two premium circles in associated playing squares;

wherein each of said at least two premium circles of each one of said nine rows of a plurality of playing squares has a number therein; and wherein said number indicates a multiple of value of a tile positioned thereon.

2. The apparatus as defined in claim 1, further comprising at least one racks; and wherein said at least one rack holds selective portions of said plurality of tiles.

3. The apparatus as defined in claim 2, wherein said at least one rack is four racks.

4. The apparatus as defined in claim 1, wherein said first row of a plurality of playing squares has two of said at least two premium circles;

wherein said two of said at least two premium circles are in a second and a fourth playing square of said first row of a plurality of playing squares, respectively; and wherein said numbers in said second and said fourth playing square of said first row of a plurality of playing squares are two and two, respectively.

5. The apparatus as defined in claim 1, wherein said second row of a plurality of playing squares has two of said at least two premium circles;

wherein said two of said at least two premium circles are in a first and a fourth playing square of said second row of a plurality of playing squares, respectively; and wherein said two of said at least two premium circles in said first and said fourth playing square of said second row of a plurality of playing squares are two and two, respectively.

6. The apparatus as defined in claim 1, wherein said third row of a plurality of playing squares has two of said at least two premium circles;

wherein said two of said at least two premium circles are in a second and a fifth playing square of said third row of a plurality of playing squares, respectively; and wherein said numbers in said second and a fifth playing square of said third row of a plurality of playing squares are two and three, respectively.

7. The apparatus as defined in claim 1, wherein said fourth row of a plurality of playing squares has three of said at least two premium circles;

wherein said three of said at least two premium circles are in a first, a fourth, and a seventh playing square of said fourth row of a plurality of playing squares, respectively; and wherein said numbers in said first, said fourth, and said seventh playing square of said fourth row of a plurality of playing squares are two, three, and two, respectively.

8. The apparatus as defined in claim 1, wherein said fifth row of a plurality of playing squares has three of said at least two premium circles;

wherein said three of said at least two premium circles are in a second, a fifth, and an eighth playing square of said fifth row of a plurality of playing squares, respectively; and wherein said numbers in said second, said fifth, and said eighth playing square of said fifth row of a plurality of playing squares are three, two, and three respectively.

9. The apparatus as defined in claim 1, wherein said sixth row of a plurality of playing squares has three of said at least two premium circles;

wherein said three of said at least two premium circles are in a first, a fourth, and a seventh playing square of said sixth row of a plurality of playing squares, respectively; and wherein said numbers in said first, said fourth, and said seventh playing square of said sixth row of a plurality of playing squares are three, three, and three respectively.

10. The apparatus as defined in claim 1, wherein said seventh row of a plurality of playing squares has three of said at least two premium circles;

wherein said three of said at least two premium circles are in a second, a fifth, and an eighth playing square of said seventh row of a plurality of playing squares, respectively; and wherein said numbers in said second, said fifth, and said eighth playing square of said seventh row of a plurality of playing squares are three, four, and three respectively.

11. The apparatus as defined in claim 1, wherein said eighth row of a plurality of playing squares has three of said at least two premium circles;

wherein said three of said at least two premium circle are in a second, a fifth, and an eighth playing square of said eighth row of a plurality of playing squares, respectively; and wherein said numbers in said second, said fifth, and said eighth playing square of said eighth row of a plurality of playing squares are four, three, and four respectively.

12. The apparatus as defined in claim 1, wherein said ninth row of a plurality of playing squares has three of said at least two premium circles;

wherein said three of said at least two premium circles are in a second, a fifth, and an eighth playing square of said ninth row of a plurality of playing squares, respectively; and wherein said numbers in said second, said fifth, and said eighth playing square of said ninth row of a plurality of playing squares are four, five, and four respectively.

13. An apparatus for sharpening anagramming skills, comprising:

a) at least one game card;

b) a plurality of tiles; and c) a tile bag;

wherein said plurality of tiles are selectively positioned on said at least one game card; and wherein said tile bag holds said plurality of tiles, wherein said at least one game card is generally square-shaped;

wherein said at least one game card has a first side edge;

wherein said at least one game card has a second side edge;

wherein said at least one game card has a top edge; and wherein said at least one game card has a bottom edge, wherein said at least one game card has nine rows of a plurality of playing squares;

wherein said nine rows of a plurality of playing squares constitute nine rounds of play;

wherein said nine rounds of play include a first round of play;

wherein said nine rounds of play include a second round of play;

wherein said nine rounds of play include a third round of play;

wherein said nine rounds of play include a fourth round of play;

wherein said nine rounds of play include a fifth round of play;

wherein said nine rounds of play include a sixth round of play;

wherein said nine rounds of play include a seventh round of play;

wherein said nine rounds of play include an eighth round of play; and wherein said nine rounds of play include a ninth round of play, wherein each one of said four game cards has a play column;

wherein said play column extends from approximately said top edge to approximately said bottom edge; and wherein said play column is disposed between said second side edge and said nine rows of a plurality of playing squares.

14. The apparatus as defined in claim 13, wherein said nine rows of a plurality of playing squares are independent of each other;

wherein said nine rows of a plurality of playing squares extend from approximately said first side edge to approximately said second side edge; and wherein said nine rows of a plurality of playing squares are spaced-apart from each other from approximately said top edge to approximately said bottom edge.

15. The apparatus as defined in claim 13, wherein said nine rows of a plurality of playing squares comprise a first row of a plurality of playing squares;

wherein said nine rows of a plurality of playing squares comprise a second row of a plurality of playing squares;

wherein said nine rows of a plurality of playing squares comprise a third row of a plurality of playing squares;

wherein said nine rows of a plurality of playing squares comprise a fourth row of a plurality of playing squares;

wherein said nine rows of a plurality of playing squares comprise a fifth row of a plurality of playing squares;

wherein said nine rows of a plurality of playing squares comprise a sixth row of a plurality of playing squares;

wherein said nine rows of a plurality of playing squares comprise a seventh row of a plurality of playing squares;

wherein said nine rows of a plurality of playing squares comprise an eighth row of a plurality of playing squares; and wherein said nine rows of a plurality of playing squares comprise a ninth row of a plurality of playing squares.

16. The apparatus as defined in claim 15, wherein said first row of a plurality of playing squares is divided into five playing squares;

wherein said second row of a plurality of playing squares is divided into five playing squares;

wherein said third row of a plurality of playing squares is divided into six playing squares;

wherein said fourth row of a plurality of playing squares is divided into seven playing squares;

wherein said fifth row of a plurality of playing squares is divided into eight playing squares;

wherein said sixth row of a plurality of playing squares is divided into nine playing squares;

wherein said seventh row of a plurality of playing squares is divided into ten playing squares;

wherein said eighth row of a plurality of playing squares is divided into ten playing squares; and wherein said ninth row of a plurality of playing squares is divided into ten playing squares.

17. The apparatus as defined in claim 13, wherein said play column has eighteen numbers;

wherein said eighteen numbers extend independently along said play column;

wherein at least a pair of said eighteen numbers are positioned adjacent said nine rows of a plurality of playing squares, respectively; and wherein each at least a pair of numbers of said eighteen numbers corresponds to a number of said tiles that must used by a player when the player is playing an associated round of play of said nine rounds of play adjacent thereto that qualifies the player for a bonus.

18. The apparatus as defined in claim 17, wherein said eighteen numbers comprise a first at least a pair of numbers;

wherein said first at least a pair of numbers are five and four;

wherein said five and said four indicate that if five or four tiles are used by a player when the player is playing said first round the player qualifies for a bonus;

wherein said eighteen numbers comprise a second at least a pair of numbers;

wherein said second at least a pair of numbers are five and four;

wherein said five and said four indicate that if five or four tiles are used by a player when the player is playing said second round the player qualifies for a bonus;

wherein said eighteen numbers comprise a third at least a pair of numbers;

wherein said third at least a pair of numbers are six and five;

wherein said six and said five indicate that if six or five tiles are used by a player when the player is playing said third round the player qualifies for a bonus;

wherein said eighteen numbers comprise a fourth at least a pair of numbers;

wherein said fourth at least a pair of numbers are seven and six;

wherein said seven and said six indicate that if seven or six tiles are used by a player when the player is playing said fourth round the player qualifies for a bonus;

wherein said eighteen numbers comprise a fifth at least a pair of numbers;

wherein said fifth at least a pair of numbers are eight and seven;

wherein said eight and said seven indicate that if eight or seven tiles are used by a player when the player is playing said fifth round the player qualifies for a bonus;

wherein said eighteen numbers comprise a sixth at least a pair of numbers;

wherein said sixth at least a pair of numbers are nine, eight, and seven;

wherein said nine, said eight, and said seven indicate that if nine, eight, or seven tiles are used by a player when the player is playing said sixth round the player qualifies for a bonus;

wherein said eighteen numbers comprise a seventh at least a pair of numbers;

wherein said seventh at least a pair of numbers are ten, nine, and eight;

wherein said ten, said nine, and said eight indicate that if ten, nine, or eight tiles are used by a player when the player is playing said seventh round the player qualifies for a bonus;

wherein said eighteen numbers comprise an eighth at least a pair of numbers;

wherein said eighth at least a pair of numbers are ten, nine, and eight;

wherein said ten, said nine, and said eight indicate that if ten, nine, or eight tiles are used by a player when the player is playing said eighth round the player qualifies for a bonus;

wherein said eighteen numbers comprise a ninth at least a pair of numbers;

wherein said ninth at least a pair of numbers are ten, nine, and eight; and wherein said ten, said nine, and said eight indicate that if ten, nine, or eight tiles are used by a player when the player is playing said ninth round the player qualifies for a bonus.

19. The apparatus as defined in claim 18, wherein each one of said four game cards has a bonus column;

wherein said bonus column extends from approximately said top edge to approximately said bottom edge; and wherein said bonus column is disposed between said second side edge and said play column.

20. The apparatus as defined in claim 19, wherein said bonus column has eighteen numbers;

wherein said eighteen numbers extend independently along said bonus column;

wherein at least a pair of said eighteen numbers are positioned adjacent said at least a pair of numbers of said play column, respectively; and wherein each at least a pair of numbers of said eighteen numbers of said bonus column corresponding to said at least a pair of numbers of said eighteen numbers of said play column indicates the bonus.

21. The apparatus as defined in claim 20, wherein said eighteen numbers of said bonus column comprise a first at least a pair of numbers;

wherein said first at least a pair of numbers are ten and zero;

wherein said ten and said zero indicate that if five or four tiles are used by a player when the player is playing said first round the player qualifies for a bonus of ten or zero, respectively;

wherein said eighteen numbers of said bonus column comprise a second at least a pair of numbers;

wherein said second at least a pair of numbers are ten and zero;

wherein said ten and said zero indicate that if five or four tiles are used by a player when the player is playing said second round the player qualifies for a bonus of ten or zero, respectively;

wherein said eighteen numbers of said bonus column comprise a third at least a pair of numbers;

wherein said third at least a pair of numbers are twenty and five;

wherein said twenty and said five indicate that if six or five tiles are used by a player when the player is playing said third round the player qualifies for a bonus of twenty or five, respectively;

wherein said eighteen numbers of said bonus column comprise a fourth at least a pair of numbers;

wherein said fourth at least a pair of numbers are thirty and ten;

wherein said thirty and ten indicate that if seven or six tiles are used by a player when the player is playing said fourth round the player qualifies for a bonus of thirty or ten, respectively;

wherein said eighteen numbers of said bonus column comprise a fifth at least a pair of numbers;

wherein said fifth at least a pair of numbers are forty and fifteen;

wherein said forty and said fifteen indicate that if eight or seven tiles are used by a player when the player is playing said fifth round the player qualifies for a bonus of forty or fifteen, respectively;

wherein said eighteen numbers of said bonus column comprise a sixth at least a pair of numbers;

wherein said sixth at least a pair of numbers are fifty, twenty, and five;

wherein said fifty, said twenty, and said five indicate that if nine, eight, or seven tiles are used by a player when the player is playing said sixth round the player qualifies for a bonus of fifty, twenty, or five, respectively;

wherein said eighteen numbers of said bonus column comprise a seventh at least a pair of numbers;

wherein said seventh at least a pair of numbers are sixty, thirty, and ten;

wherein said sixty, said thirty, and said ten indicate that if ten, nine, or eight tiles are used by a player when the player is playing said seventh round the player qualifies for a bonus of sixty, thirty, or ten, respectively;

wherein said eighteen numbers of said bonus column comprise an eighth at least a pair of numbers;

wherein said eighth at least a pair of numbers are seventy-five, forty, and twenty;

wherein said seventy-five, said forty, and said twenty indicate that if ten, nine, or eight tiles are used by a player when the player is playing said eighth round the player qualifies for a bonus of seventy-five, forty, or twenty, respectively;

wherein said eighteen numbers of said bonus column comprise a ninth at least a pair of numbers;

wherein said ninth at least a pair of numbers are one hundred, fifty, and thirty; and wherein said one hundred, said fifty, and said thirty indicate that if ten, nine, or eight tiles are used by a player when the player is playing said ninth round the player qualifies for a bonus of one hundred, fifty, or thirty, respectively.

22. An apparatus for sharpening anagramming skills, comprising:

a) at least one game card;

b) a plurality of tiles; and c) a tile bag;

wherein said plurality of tiles are selectively positioned on said at least one game card; and wherein said tile bag holds said plurality of tiles, wherein said at least one game card is four game cards;

wherein said four game cards are identical to each other; and wherein said plurality of tiles are one hundred and three tiles, wherein said one hundred and three tiles comprise ninety-six lettered tiles;

wherein said one hundred and three tiles comprise four blank tiles; and wherein said one hundred and three tiles comprise three bonus tiles.

23. The apparatus as defined in claim 22, wherein each of said four blank tiles is used as any letter to form a word but has no point value;

wherein each of said three bonus tiles is redeemable for two additional tiles; and wherein said three bonus tiles are not interchangeable with said four blank tiles.

24. A game method for sharpening anagramming skills utilizing apparatus, wherein the apparatus includes 103 tiles having 96 lettered tiles with letter values, 4 blank tiles, and 3 bonus tiles, wherein a blank tile can be used as any letter to form a word but has no point value, a bonus tile is redeemed for two additional tiles, with all tiles redeemed from a bonus tile being kept and not returned or exchanged for any reason, wherein the bonus tile cannot be used as a blank and cannot be returned to the tile bag until the round is over but if in redeeming a bonus tile another bonus tile is drawn it can be redeemed, a tile bag, a game card having a draw column thereon, a bonus column thereon, and game lines with bonus circles thereon, and a rack, said method comprising the steps of:

a) agreeing before the game what dictionary to use as a reference source, wherein all words labeled as parts of speech including those listed as of foreign origin or as archaic, obsolete, colloquial, slang, are allowed with exception of words always capitalized, abbreviations, prefixes and suffixes standing alone, and words requiring a hyphen or an apostrophe;

b) placing all of the tiles in the tile bag;

c) mixing all of the tiles;

d) receiving a game card;

e) drawing from the tile bag the number of the tiles indicated under the draw column on the game card for that particular round so as to form drawn tiles;

f) determining if the drawn tiles are to be returned;

g) returning the drawn tiles if answer to step f) is yes;

h) drawing again so as to form a second draw if step g) is carried out;

i) keeping the second draw if step h) is carried out;

j) going to step s) if step i) is carried out;

k) determining if one tile is to be discarded if answer to step f) is no;

l) exchanging the one tile for another tile so as to form a new tile if answer to step k) is yes;

m) keeping the new tile if step l) is carried out;

n) determining if the new tile is a bonus tile if step m) is carried out;

o) redeeming the bonus tile if answer to step n) is yes;

p) going to step z) if step o) is carried out;

q) going to step z) if answer to step n) is no;

r) going to step s) if answer to step k) is no;

s) determining if there are duplicate tiles in excess of two;

t) returning all duplicate tiles in excess of two so as to form at least three new tiles if answer to step s) is yes;

u) keeping the at least three new tiles if step t) is carried out;

v) determining if any of the at least three new tiles is a bonus tile if step u) is carried out;

w) redeeming the bonus tile if answer to step v) is yes;

x) going to step z) if step w) is carried out;

y) going to step z) if answer to step v) is no;

z) placing the drawn tiles in the rack;

aa) forming a word on the game card with the tiles drawn from the tile bag for each round, wherein in no round is a word less than three letters allowed, and wherein words can be started any place on the playing line of the game card;

bb) tallying the score by summing the letter value,of each word formed plus any additional points obtained from placing letters on the premium circles and bonuses awarded as indicated in the bonus column on the game card;

cc) completing the round;

dd) returning the drawn tiles to the tile bag;

ee) determining if the round is the last round;

ff) determining if there is a tie if answer to step ee) is yes;

gg) playing additional rounds until a winner is determined if answer to step ff) is yes;

hh) winning game by player with highest score if answer to step ff) is no;

ii) mixing all of the tiles for the next round if step gg) is carried out; and jj) returning to step ee) if step ii) is carried out.

25. An apparatus for sharpening anagramming skills, comprising:

a) at least one same card;

b) a plurality of tiles; and c) a tile bag;

wherein said plurality of tiles are selectively positioned on said at least one game card; and wherein said tile bag holds said plurality of tiles, wherein said at least one game card is generally square-shaped;

wherein said at least one game card has a first side edge;

wherein said at least one game card has a second side edge;

wherein said at least one game card has a top edge; and wherein said at least one same card has a bottom edge, wherein said at least one game card has nine rows of a plurality of playing squares;

wherein said nine rows of a plurality of playing squares constitute nine rounds of play;

wherein said nine rounds of play include a first round of play;

wherein said nine rounds of play include a second round of play;

wherein said nine rounds of play include a third round of play;

wherein said nine rounds of play include a fourth round of play;

wherein said nine rounds of play include a fifth round of play;

wherein said nine rounds of play include a sixth round of play;

wherein said nine rounds of play include a seventh round of play;

wherein said nine rounds of play include an eighth round of play; and wherein said nine rounds of play include a ninth round of play, wherein each one of said game cards has a draw column;

wherein said draw column extends from approximately said top edge to approximately said bottom edge; and wherein said draw column is disposed between said first side edge and said nine rows of a plurality of playing squares, wherein said draw column has nine numbers;

wherein said nine numbers extend independently along said draw column;

wherein said nine numbers are positioned adjacent said nine rows of a plurality of playing squares, respectively; and wherein each of said nine numbers corresponds to a number of said tiles to be drawn by a player when the player is playing a round of play of said nine rounds of play adjacent thereto, wherein said nine numbers comprise a first number;

wherein said first number is six;

wherein said six indicates that six tiles are to be drawn by a player when the player is playing said first round;

wherein said nine numbers comprise a second number;

wherein said second number is six;

wherein said six indicates that six tiles are to be drawn by a player when the player is playing said second round;

wherein said nine numbers comprise a third number;

wherein said third number is eight;

wherein said eight indicates that eight tiles are to be drawn by a player when the player is playing said third round;

wherein said nine numbers comprise a fourth number;

wherein said fourth number is ten;

wherein said ten indicates that ten tiles are to be drawn by a player when the player is playing said fourth round;

wherein said nine numbers comprise a fifth number;

wherein said fifth number is eleven;

wherein said eleven indicates that eleven tiles are to be drawn by a player when the player is playing said fifth round;

wherein said nine numbers comprise a sixth number;

wherein said sixth number is twelve;

wherein said twelve indicates that twelve tiles are to be drawn by a player when the player is playing said sixth round;

wherein said nine numbers comprise a seventh number;

wherein said seventh number is fourteen;

wherein said fourteen indicates that fourteen tiles are to be drawn by a player when the player is playing said seventh round;

wherein said nine numbers comprise an eighth number;

wherein said eighth number is twelve;

wherein said twelve indicates that twelve tiles are to be drawn by a player when the player is playing said eighth round;

wherein said nine numbers comprise a ninth number;

wherein said ninth number is ten; and wherein said ten indicates that ten tiles are to be drawn by a player when the player is playing said ninth round.

* * * * *